United States Patent [19]

Boyadjieff

[11] Patent Number: 4,696,207

[45] Date of Patent: Sep. 29, 1987

[54] WELL PIPE HANDLING MACHINE

[75] Inventor: George I. Boyadjieff, Anaheim, Calif.

[73] Assignee: Varco International, Inc., Orange, Calif.

[21] Appl. No.: 854,404

[22] Filed: Apr. 21, 1986

Related U.S. Application Data

[62] Division of Ser. No. 727,724, Apr. 26, 1985.

[51] Int. Cl.[4] ..... B25B 13/50

[52] U.S. Cl. ..... 81/57.34; 414/22; 211/60.1

[58] Field of Search ..... 81/57.34; 175/52, 85; 414/22, 745; 182/114; 211/60.1

[56] References Cited

U.S. PATENT DOCUMENTS

| | | | |
|---|---|---|---|
| 2,737,839 | 3/1956 | Paget | 81/57.35 |
| 2,909,288 | 10/1959 | Boudette . | |
| 3,633,767 | 1/1972 | Mitchell et al. | 175/85 |
| 4,042,123 | 8/1977 | Sheldon et al. | 214/2.5 |
| 4,163,625 | 8/1979 | Jenkins | 414/22 |

*Primary Examiner*—Frederick R. Schmidt
*Assistant Examiner*—Maurina Rachuba
*Attorney, Agent, or Firm*—William P. Green

[57] ABSTRACT

A well pipe handling machine for removing a series of stands of pipe from the upper end of a well pipe string and storing the stands in a rack offset to a side of the well axis and/or returning the stands sequentially from the rack for reconnection to the string. The machine includes a support which carries means for holding a pipe in vertical condition and is movable between a position in which the pipe is in alignment with the well axis and a location near the storage rack, and which preferably takes the form of a vertically extending column structure movable horizontally by two synchronized drive mechanisms at the top and bottom of the column structure. The pipe holding means are desirably shiftable upwardly and downwardly relative to the support and also generally horizontally toward and away from the support for placement of the pipe stands in the rack and removal therefrom. The pipe holding means may include two vertically spaced pipe gripping units mounted by a parallelogram mechanism for movement toward and away from the support. The machine also may include apparatus for turning a pipe stand to connect it to or disconnect it from the string, with this apparatus being movable with the support and pipe holding units between the well axis and the storage rack.

64 Claims, 24 Drawing Figures

FIG. 10
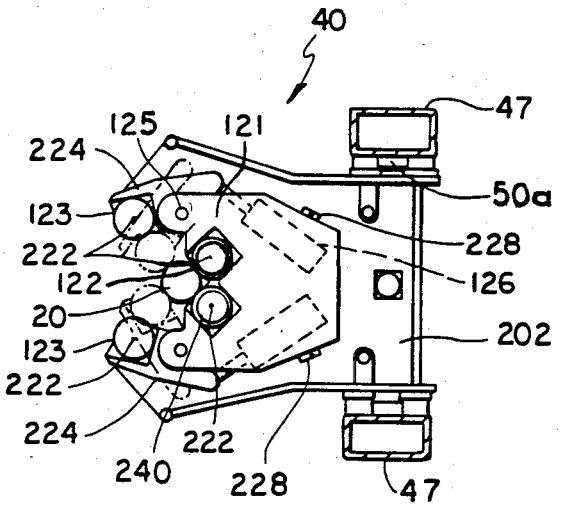
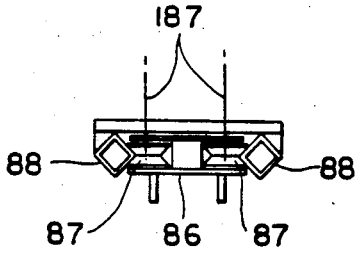
FIG. 11
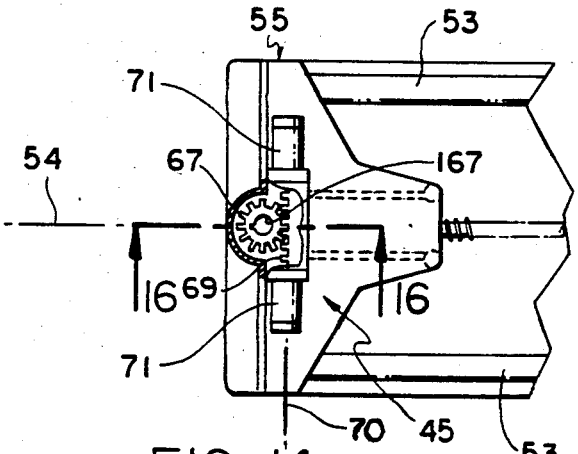
FIG. 14
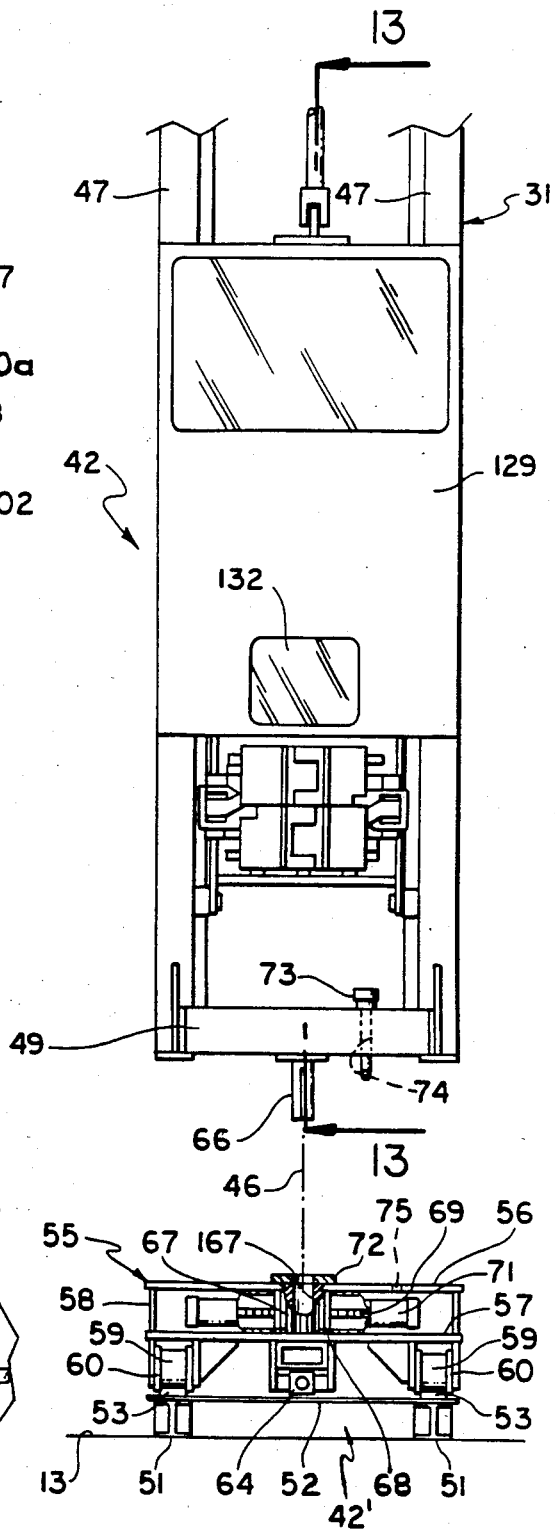
FIG. 12

FIG. 18
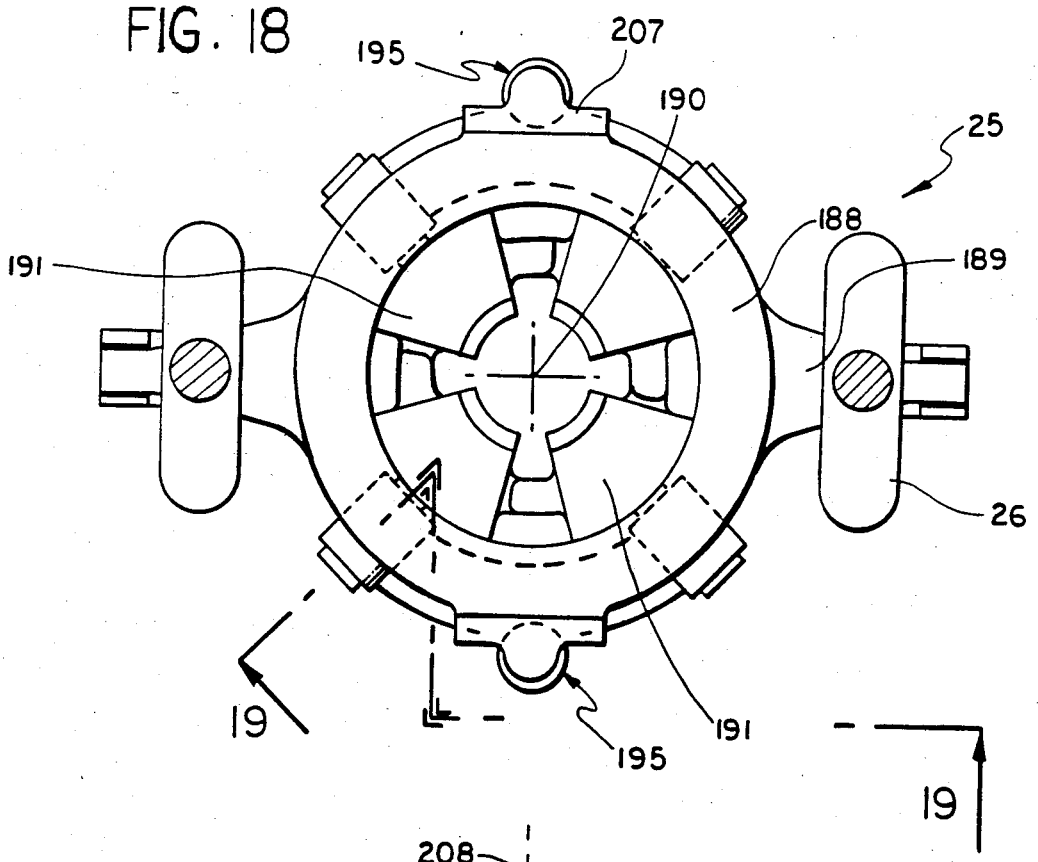
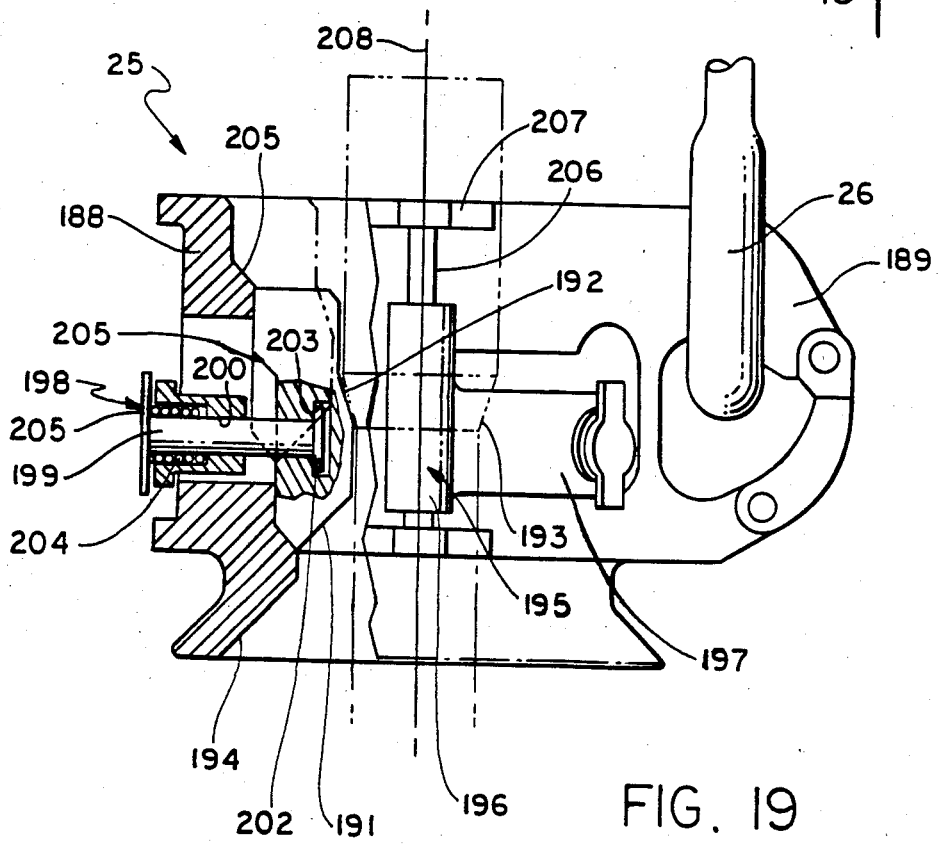
FIG. 19

FIG. 20
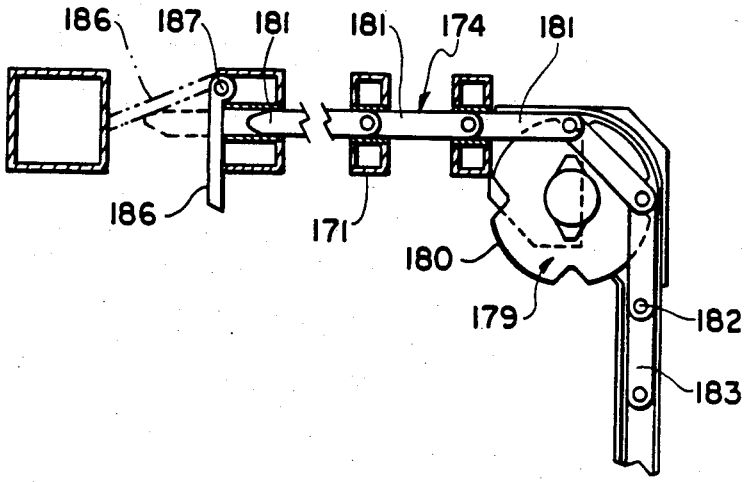
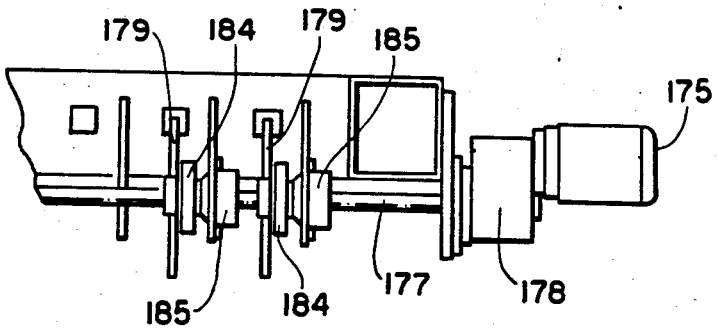
FIG. 21

WELL PIPE HANDLING MACHINE

This is a division, of application Ser. No. 6/727,724, filed Apr. 26, 1985, pending.

BACKGROUND OF THE INVENTION

This invention relates to machines for assisting in connecting a series of pipe stands to or disconnecting them from the upper end of a string of well pipe.

When it becomes necessary during the drilling of a well to remove the entire drill string from the well, in order to replace a bit at the lower end of the string or for other reasons, the various stands which make up the string are sequentially detached from the upper end of the string and temporarily stored in a rack in a side of the derrick. After the bit has been replaced or another desired operation has been performed, the stands are sequentially removed from the rack and returned into the hole. This round trip procedure requires the presence of several men on the rig floor for making and breaking connections and moving the pipe stands, and also requires a derrickman at an elevated location in the rig for controlling the pipe at that location and moving the upper ends of the pipe stands into and out of the racking board. In addition to the expense involved, the round tripping procedure is dangerous to all of the men on the rig, and very time consuming. There have been attempts in the past to mechanize some of the steps involved in handling the pipe during a round trip, but none of these prior expedients has to my knowledge proven effective or practical enough for any wide scale adoption in the actual drilling of wells.

SUMMARY OF THE INVENTION

The general purpose of the present invention is to provide an improved pipe handling machine which can be utilized in a conventional drilling rig with a standard derrick structure and which can perform all of the pipe handling and racking operations during a round trip with fewer persons on the rig, preferably a single operator, and desirably with no manual pipe handling steps. The machine can function under the control of a single operator to make and break threaded connections and move each stand very positively between a position of alignment with the well axis and a storage location. The machine can handle stands of both drill pipe and drill collars, and can also be utilized for handling casing.

A machine embodying the invention includes a support which preferably takes the form of a vertically extending column and which carries means for holding a pipe in vertically extending condition, and which is bodily shiftable to move the pipe from the location of the well axis to a laterally offset position near a storage rack. The pipe holding means desirably include two pipe holding units at vertically spaced locations for engaging and gripping the pipe at those spaced locations to very positively locate and control the movements of the pipe. Two synchronized drive mechanisms may engage the column at vertically spaced locations, preferably at the upper and lower ends of that structure, and be operable to move those portions in unison with one another in a manner effecting the desired horizontal bodily shifting movement of the column and carried parts while continuously maintaining the supported pipe in vertical condition.

In the retracted position offset to a side of the well axis, the pipe holding units and carried pipe stand may be shiftable laterally relative to the column structure to move the pipe to a racked position. For this purpose, the synchronized drive mechanisms desirably include pivotal connections mounting the column to pivot about a vertical axis in order to face in a proper direction for movement of the pipe stand into a racking board. The pipe holding units may be moved horizontally in correspondence with one another relative to the column to perform the racking and unracking function. This generally horizontal movement of the pipe holding units and carried pipe may be attained by connecting the units to the column through a parallelogram machanism having swinging arms mounting the two units respectively and swinging together toward and away from the column and relative to the racking board.

In order to allow the pipe to be raised and lowered relative to the string and the rig floor and other portions of the rig, the pipe holding means may be mounted to a carriage structure which is shiftable upwardly and downwardly relative to the main column structure or support of the apparatus. The machine may also include a spinner and torque wrench for making and breaking connections between the pipe string and a stand being connected to or detached from the string. These elements are preferably shiftable upwardly and downwardly with the carriage and pipe holding units, and the torque wrench may also be movable upwardly and downwardly relative to the spinner and other parts of the apparatus. In order to facilitate control of the apparatus, the machine may include a control station in the form of a cab adapted to contain or support an operator and having control equipment for actuating the various movable parts of the apparatus. This control station may be mounted for movement upwardly and downwardly relative to the supporting column and with the pipe holding units and other elements, and preferably also for pivotal movement with the various pipe supporting parts and other related elements to properly face the racking board during movement of a pipe into or out of the rack.

BRIEF DESCRIPTION OF THE DRAWINGS

The above and other features and objects of the invention will be better understood from the following detailed description of the typical embodiment illustrated in the accompanying drawings, in which:

FIGS. 8, 9 and 10 are plan views of the upper and lower pipe holding units and the spinning wrench taken on lines 8, 9—9 and 10—10 respectively of FIG. 7;

FIG. 11 is a vertical section taken on line 11—11 of FIG. 7;

FIG. 12 is an enlarged fragmentary exploded view of the lower portion of the machine taken on line 12—12 of FIG. 1;

FIG. 14 is a view taken on line 14—14 of FIG. 13;

FIG. 18 is an enlarged top plan view of the remotely controlled elevator taken on line 18—18 of FIG. 1;

FIG. 19 is a partially elevational and partially sectional view of the elevator taken on line 19—19 of FIG. 18;

FIGS. 20 and 21 are enlarged fragmentary vertical sections taken on lines 20—20 and 21—21 respectively of FIG. 3;

DESCRIPTION OF THE PREFERRED EMBODIMENT

Figure 1:
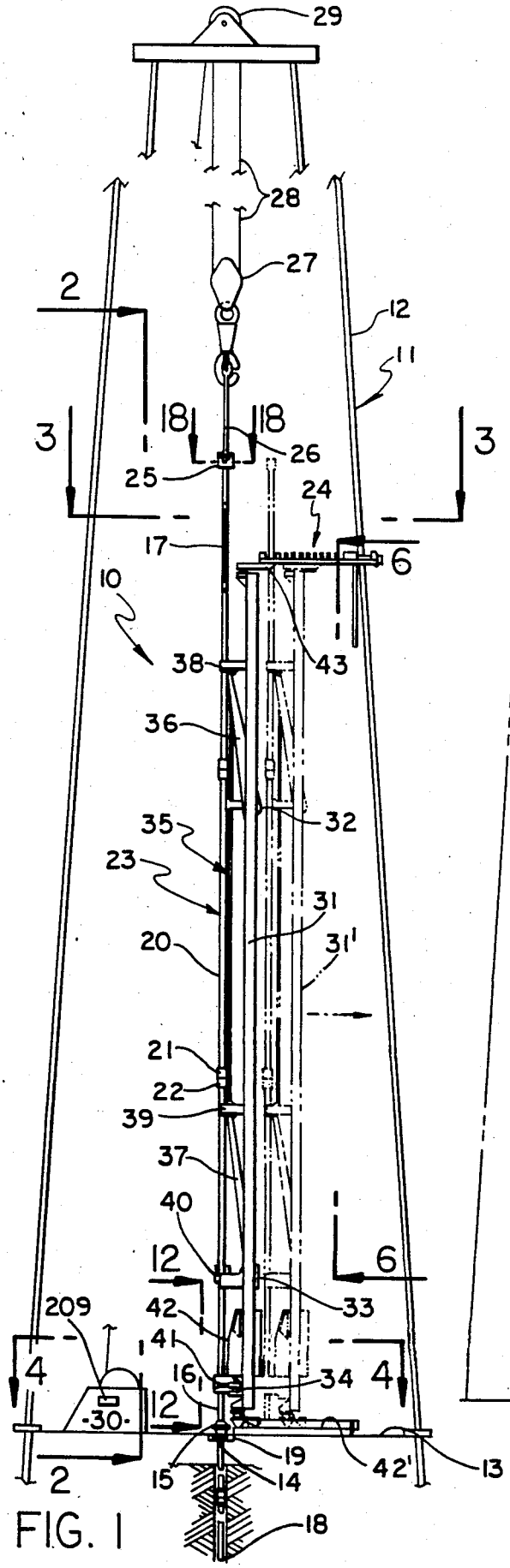
FIG. 1 is a side view of a well pipe handling machine embodying the invention shown in a position of engagement with the upper end of a drill string in a drilling rig.
Figure 2:
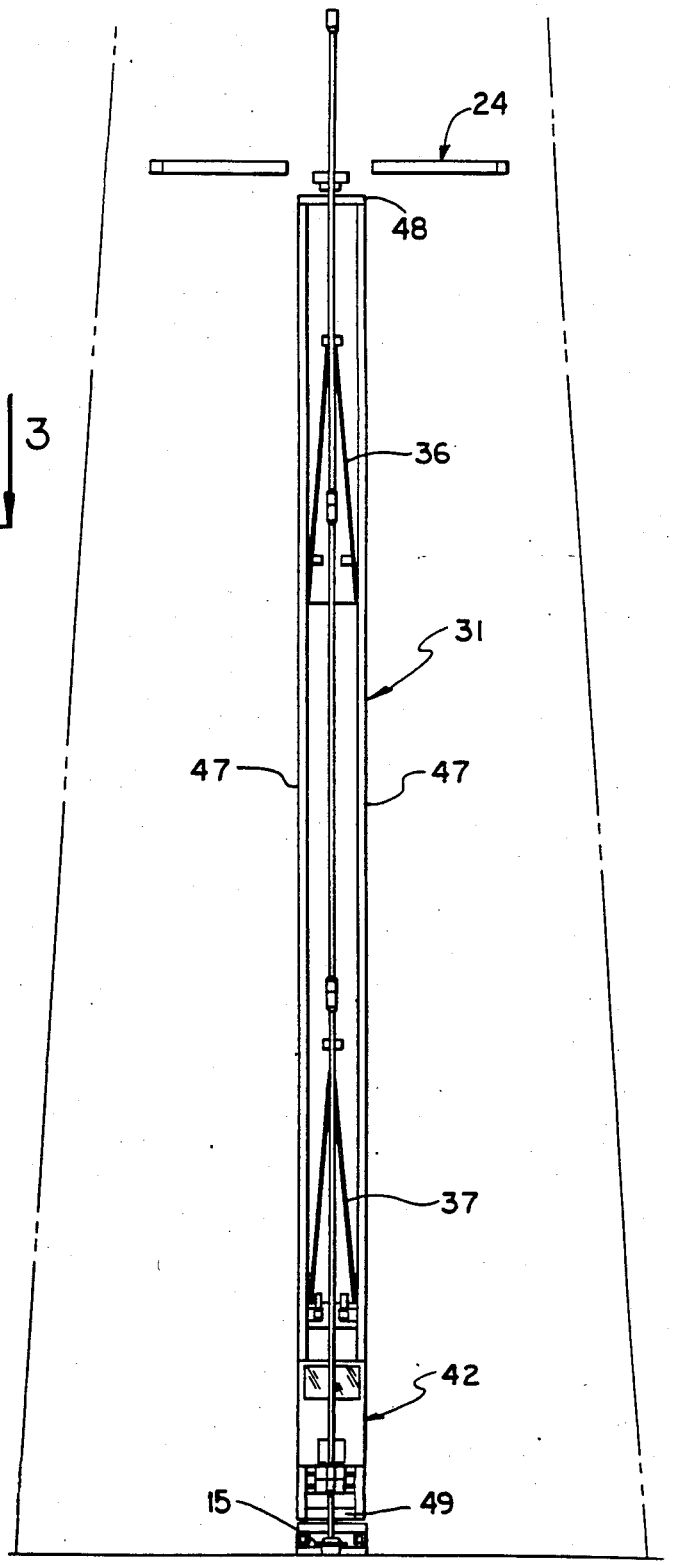
FIG. 2 is a front view of the machine taken on line 2—2 of FIG. 1.

There is illustrated at 10 in FIG. 1 a well pipe handling machine constructed in accordance with the invention and shown positioned within a somewhat diagrammatically represented drilling rig 11 including a derrick 12 having a rig floor 13 containing an opening 14 within which a slip assembly 15 is receivable for releasably supporting a drill string 16 extending along a vertical axis 17 and downwardly into a well 18. The rig is typically illustrated as a conventional arrangement in which the slip supporting opening 14 is contained within a rotary table 19 which turns the string during a drilling operation. It will be understood, however, that the machine may also be utilized in a top drive system in which a motor connected to the upper end of the string drives it rotatively and is movable upwardly and downwardly with the string during drilling. The drill string is formed in conventional manner of a series of pipe sections 20 each having a lower externally threaded pin end 21 connected to an upper internally threaded box end 22 of the next successive section. During a round trip of the string out of and then back into the well, the string is broken into a series of stands 23 each including three of the interconnected pipe sections 20, with these stands being moved by the machine 10 from the center line position of stand 23 in FIG. 1 to storage positions within a racking board assembly 24. The pipe string is raised and lowered by a remotely controlled elevator 25 suspended by links 26 from a traveling block 27, which in turn is suspended on a line 28 from a crown block 29 attached to the top of the derrick, with the line being actuable by draw works 30 to move the elevator upwardly and downwardly.

Figure 13:
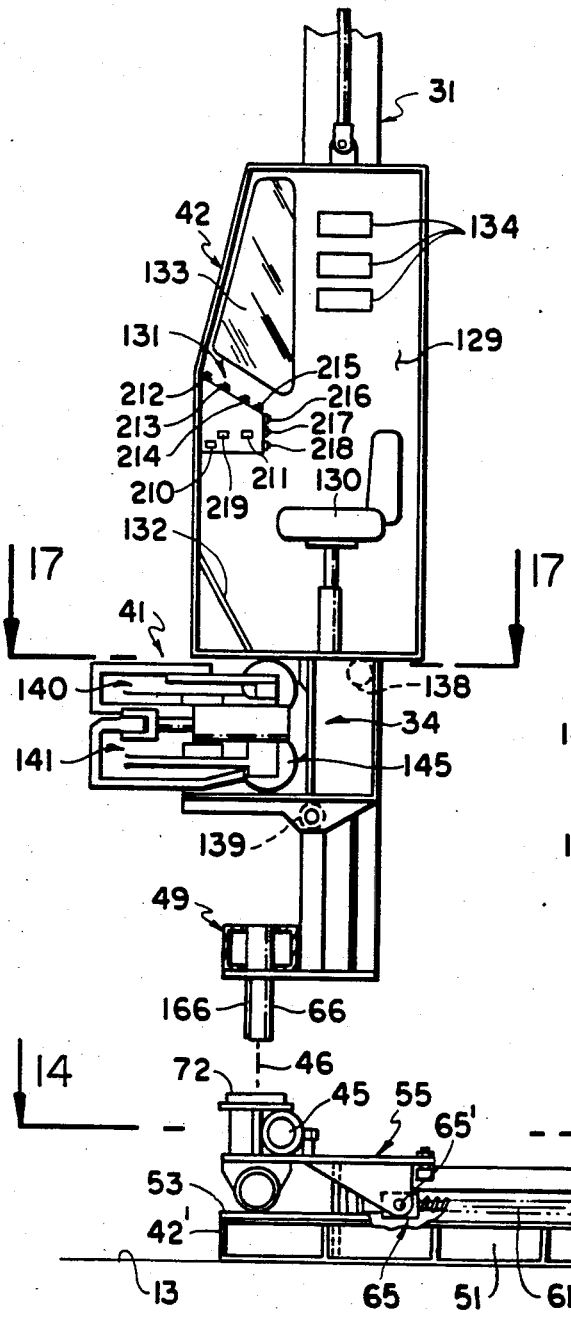
FIG. 13 is a fragmentary vertical section taken primarily on line 13—13 of FIG. 12.
Figure 15:
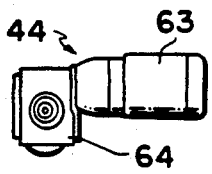
FIG. 15 is a fragmentary rear elevational view taken on line 15—15 of FIG. 13.
Figure 15:
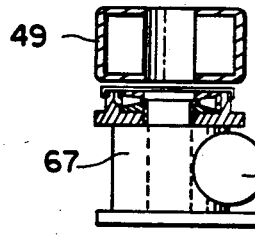
Figure 16:
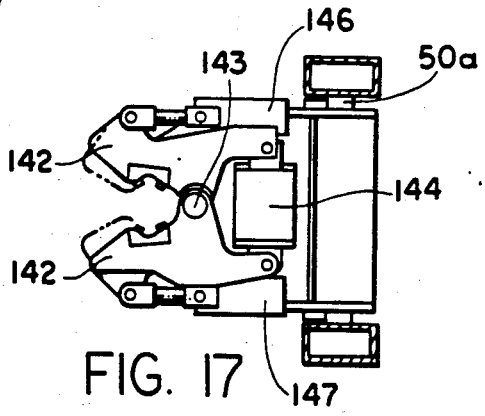
FIG. 16 is a fragmentary vertical section taken on line 16—16 of FIG. 14.

The moving parts of machine 10 are carried principally by a vertical column structure 31 to which three carriages 32, 33 and 34 are mounted for upward and downward movement. The upper two carriages in turn support a parallelogram mechanism 35 having upper and lower arms 36 and 37 movably supporting an upper pipe holding or clamping unit 38 and a lower pipe holding or clamping unit 39. Carriage 33 also mounts a spinner 40 for turning the pipe rapidly, and the lower carriage 34 supports a torque wrench 41 and a control cab or station 42 within which the single operator of the machine is located. The column structure 31 is movably supported at its lower end on a base 42' connected to rig floor 13, and is connected movably at its upper end to racking board 24. Two synchronized drives 43 (FIG. 7) and 44 (FIG. 13) move the upper and lower ends of the column structure leftwardly and rightwardly in unison as viewed in FIG. 1, and a rotary drive 45 (FIG. 13) at the lower end of the column structure controllably pivots it about a vertical axis 46.

Column structure 31 is a rigid vertical framework including two similar spaced parallel vertical column elements 47 joined together at their upper ends by a horizontal connector member 48 welded or otherwise secured to elements 47, and secured together at their lower ends by a horizontal connector member 49 also appropriately rigidly secured to elements 47. Elements 47 may have the hollow rectangular configuration illustrated in FIG. 10 along the entire vertical extent of elements 47. At their inner sides, elements 47 rigidly carry an upper pair of vertical track or rail elements 50, and a similar lower pair of track or rail elements 50*a*, to guide the various carriages 32, 33 and 34 for upward and downward movement. All of these track members 50 and 50*a* may have the rectangular horizontal configuration illustrated in FIG. 10.

The base 42' on which column structure 31 is mounted (FIGS. 12 and 13) is a rigid structure appropriately bolted or otherwise secured in fixed position on the rig floor 13, and typically including two parallel side beams 51 acting as load support beams and carrying a horizontal top plate 52 extending across the upper side of base 42', with two parallel horizontal tracks 53 being welded, bolted or otherwise secured to plate 52 and beams 51. Tracks 53 are located at opposite sides of and equidistant from, and extend parallel to, a vertical plane 54 (FIG. 14) which contains the main vertical axis 17 of the well and extends radially with respect thereto. A carriage 55 is movable horizontally along tracks 53 and radially with respect to well axis 17, and may include upper and lower rigid plates 56 and 57 and vertical connectors 58 extending between and securing together the plates 56 and 57, with wheels 59 mounted rotatably to the body of the carriage at its underside. These wheels engage the two tracks 53 and roll along it, and have annular flanges 60 at their opposite sides engageable with opposite sides of the tracks to effectively retain the wheels on the tracks and thus guide the carriage for only straight line horizontal movement along an axis 61 extending perpendicular to and intersecting well axis 17. The carriage is power actuable along this axis and further guided by a lead screw 62 connected rotatably to base 42 at its upper side to turn about axis 61. A motor 63 drives screw 62 in opposite directions through a worm gear transmission 64, and inherently brakes the screw in any setting to which it may be turned and so long as the motor is not energized. A nut 65 engages the screw and is actuated axially thereby upon powered rotation of the screw, and is attached to carriage 55 at 65, to thus move the carriage horizontally along axis 61 when the motor is energized.

The lower end of column structure 31 is connected pivotally to carriage 55 by reception of a downwardly projecting pivot pin 66 carried by a lower horizontal element 49 of the column structure within a central opening 167 in a pinion gear 67 mounted on the carraige for rotation relative thereto about vertical axis 46. This pinion gear is journalled for such rotation by bearings represented at 68, and is retained against rotation relative to pin 66 by a key 166 to positively turn column structure 31 about axis 46 upon rotation of the pinion gear. A toothed rack 69 engages pinion 67 and is actuable along a horizontal axis 70 by one or more piston and cylinder mechanisms represented at 71 to turn the pinion gear and connected column structure 31 about axis 46 in response to the delivery of pressure fluid to the piston and cylinder mechanisms 71. The column structure can thus be moved pivotally about axis 46 by the hydraulic rotary rack and pinion actuator 67–69, and be moved toward and away from the main axis of the well by motor 63. The weight of the column structure is supported on carriage 55 by a thrust bearing represented at 72, and is transmitted from the carriage to base 42' by wheels 59 and tracks 53. The carriage structure and carried parts may be locked in the position of FIG. 1 by insertion of a cylindrical locking pin 73 (FIG. 12) downwardly through a vertical passage 74 in horizontal bottom member 49 of the column structure and through a registering opening 75 formed in carriage 55. In this FIG. 1 position, the various pipe holding and actuating elements 38, 39, 40 and 41 have their gripping portions in axial alignment with one another and all centered about the main vertical axis 17 of the well, to hold and drive a pipe extending vertically along that axis. Rotary actuator 45 consisting of pinion 67, rack 69 and power cylinders 71 can turn the column structure through exactly 90° in either direction from the FIG. 1 position, with the pivotal motion being positively limited by engagement of appropriate stop shoulders on the pivotally connected parts in those extreme 90° positions, to properly locate the pipe holding units for movement of a carried pipe into and out of storage locations in the racking board, as will be discussed in greater detail at a later point.

The upper end of the column structure 31 is mounted by a powered straight line drive mechanism which is synchronized to the straight line drive at the lower end of the column, to move the upper and lower ends in unison at all times, and thus maintain the column structure and a pipe held thereby continuously in directly vertical condition. More specifically, the drive structure at the upper end of the column may be mounted to the underside of a central portion 76 of racking board 24 and include a lead screw 77 mounted to portion 76 by bearings 78 for rotation about a horizontal axis 79 extending parallel to the axis 61 of lower screw 62 and intersecting axes 17 and 46. A motor 80 drives screw 77 about axis 79 through a self-braking worm gear transmission 81, to actuate a nut 82 axially upon rotation of the motor in either of two opposite directions. Nut 82 is in turn connected rigidly to the upper side of a structure 83 which carries a vertical pivot pin 84 centered about axis 46 and aligned vertically with lower pivot pin 66. This pin 84 is closely received and journalled within openings in a pair of bearing plates 85 attached to the upper end of the column structure, to thus locate the upper end of the column structure for pivotal movement about the same axis as the lower end of that structure. The structure 83 which carries pivot pin 84 may include a horizontal plate 86 carrying two pairs of rollers 87 at its upper side mounted for rotation about spaced vertical axes 187 and engaging two parallel horizontally extending guide tubes 88 attached rigidly to member 76 of the racking board assembly. Tubes 88 may have the square vertical cross-sectional configuration illustrated in FIG. 11, to project into annular grooves in the rollers 87, in a manner effectively guiding structure 83 and pivot pin 84 and the upper end of the column structure for movement only along axis 79 of screw 77. Motors 80 and 63 are connected to a common source of power to be energized precisely in unison and always actuate the upper and lower screws and the upper and lower ends of the column structure in exact correspondence with one another.

The upper vertically movable carriage 32 has an upper pair of rollers 89 (FIG. 6) engaging the back sides of the two track elements 50, and has a second pair of rollers 90 engaging the front sides of tracks 50 to effectively guide the carriage for only up and down movement relative to and along column structure 31, and parallel to the vertical pivotal axis 46. Carriage 32 may be fabricated of a number of parts welded together, typically including a plate 91, and two members 92 which carry rollers 89 rotatably and converge toward one another for pivotal connection at 93 to the piston of a piston and cylinder mechanism 94 whose cylinder is pivoted to arm 36 at 95. The axes of the pivotal connections 93 and 95 are desirably horizontal and parallel to one another to enable the piston and cylinder mechanism to swing the arm between its FIG. 1 and FIG. 5 positions relative to the column structure.

Figure 6:
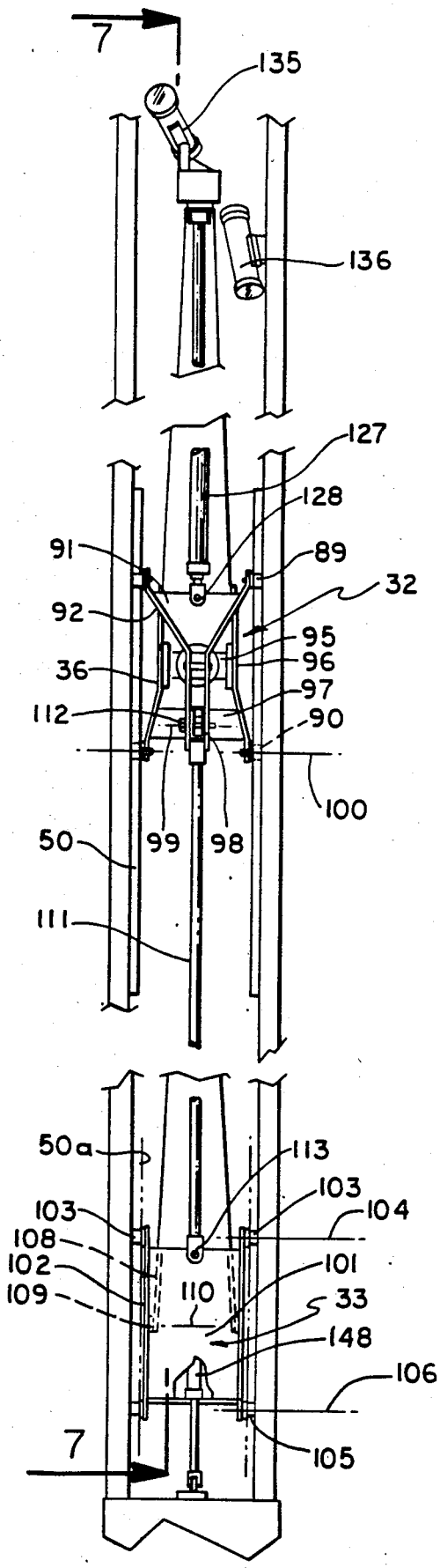
FIG. 6 is an enlarged fragmentary rear elevational view of the machine taken on line 6—6 of FIG. 1.
Figure 7:
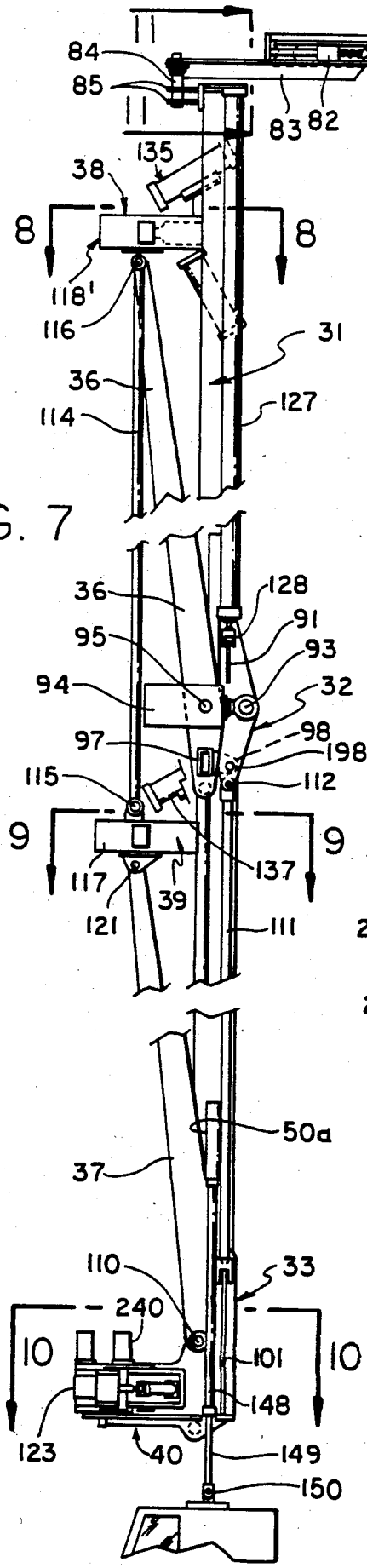
FIG. 7 is a fragmentary vertical sectional view taken primarily on line 7—7 of FIG. 6.

Arm 36 is an elongated rigid structure which may taper to a reduced width as shown and may be formed of metal plates welded together in the configuration illustrated. The inner end of the arm includes a pair of generally parallel side plates 96 (FIG. 6) rigidly secured together by a cross member 97 which is typically of rectangular configuration as illustrated in FIG. 7. The pivotal connections 95 between the cylinder of piston and cylinder mechanism 94 and arm 36 may be attached to side plates 96 of the inner portion of the arm. A bearing lug 98 may project from cross piece 97 of the arm and be connected pivotally at 198 to lower portions of the members 92 of carriage 32, with the axis 99 of that pivotal connection being horizontal and parallel to the axes of rollers 89 and 90 and pivotal connections 93 and 95. Rollers 90 may be mounted to the inner end of arm 36, by rotary attachment of the lower extremities of side plates 96 of the arm. Rollers 90 thus serve a dual purpose of coacting with upper rollers 89 in guiding the carriage and arm for upward and downward movement and also mounting arm 36 for pivotal movement about the horizontal axis 100 of rollers 90.

The second vertically movable carriage 33 may include a vertical plate 101 (FIGS. 6 and 7) carrying two parallel side plates 102 to which there are rotatably mounted an upper pair of rollers 103 turning about a horizontal axis 104 and engaging the rear sides of tracks **50*a* and a lower pair of rollers 105 turning about a parallel horizontal axis 106 and engaging front sides of the tracks 50*a*. Arm 37 may be fabricated of metal plates as discussed in connection with arm 36 and include two spaced plates 108 at the inner end of the arm connected pivotally by bearings 109 to side plates 102 of the carriage, to mount arm 37 for swinging movement about a horizontal axis 110 extending parallel to and spaced beneath and vertically aligned with the horizontal axis 100 about which upper arm 36 swings. The two arms 36 and 37 have identical effective lengths and form parts of the parallelogram mechanism 35 which functions to cause the arms to swing exactly in unison with one another and at all times be positioned at exactly the same angle to the vertical. Carriages 32 and 33 are attached together for movement upwardly and downwardly in unison by a rigid vertical rod 111 (FIG. 6) connected at its upper end to the lower extremities of members 92 of carriage 32 by a bolt 112 and at its lower end to plate 101 of carriage 33 by a bolt 113. This arm thus forms a third side of the parallelogram mechanism, with the fourth side being formed by another rigid vertical rod 114 attached at its lower end by a connection 115 to pipe holding unit 39, and attached at its upper end by a pivotal connection 116 to the extremity of arm 36. The body 117 of pipe holding unit 39 may be rigidly attached to the lower end of rod 114 so that the rod will always maintain unit 39 in directly horizontal condition, with the axis of the gripping jaws 118 of unit 39 in vertical condition, and similarly the upper end of rod 114 may be connected rigidly to a body 118' of upper pipe holding unit 38 to maintain that unit in directly horizontal condition and parallel to lower unit 39, with the gripping axis 119 of unit 38 extending vertically and aligned with the gripping aixs 120 of lower unit 39. Unit 39 is pivotally connected at its underside to the extremity of arm 37 by a connection represented at 121. The distance between axes 110 and 121 at the opposite ends of the lower arm 37 is exactly equal to the distance between the pivotal axes 100 and 116 at the opposite ends of arms 36, and the effective length of the structure extending vertically between pivotal connections 116 and 121 and consisting of rod 114 and the body of lower gripping unit 39 is exactly equal to the effective length of the structure connecting carriages 32 and 33 and including rod 111**.

In addition to functioning as the pivotal mounting for lower arm 37, carriage 33 also acts as the support for spinning wrench 40. This wrench may be of essentially conventional construction, including a body 121 rigidly but preferably removably attached to carriage 33, and typically illustrated as supported on a bottom plate 202 of the carriage and secured thereto by fasteners represented at 228. Body 121 of the spinner carries two inner rollers 122 and two outer rollers 123 turning about four parallel vertical axes 222 and driven about those axes by individual motors 240 operating in unison with one another. The two inner rollers 122 may be fixed at locations to engage the inner side of a well pipe stand 23 and the two outer rollers 123 may be mounted to arms 224 connected pivotally at 125 to body 121 of the spinner for swinging movement toward and away from one another between the open full line positions of FIG. 10 and the closed broken line positions of that figure. In the open positions of rollers 123, those rollers are spaced apart a distance greater than the diameter of the pipe to be held, and can thus be moved onto and off of the pipe, while in the closed broken line positions of FIG. 10 all four of the rollers engage the pipe to effectively rotate it about the vertical axis of the pipe upon energization of the driving motors. Arms 124 and the carried rollers 123 are actuable between their full line and broken line positions of FIG. 10 by piston and cylinder mechanisms 126 having their cylinders attached to body 121 of the spinner and their pistons attached to the arms or levers 224. In the closed condition of the rollers, the axis of the spinner and of a pipe held and driven by the spinner is exactly aligned vertically with the axes of pipe holding units 38 and 39 in their FIG. 1 positions, to thus spin a pipe held by these units 38 and 39. As will be understood, motors 240 can drive the rollers in opposite directions, to turn the pipe in a direction to either screw two pipe sections together or threadedly detach them.

The two carriages 32 and 33 are power actuated upwardly and downwardly together by a single vertically extending piston and cylinder mechanism 127, whose cylinder may be attached at its upper end to the top of column structure 31, and whose piston may be attached at 128 to plate 91 of the upper carriage.

Figure 5:
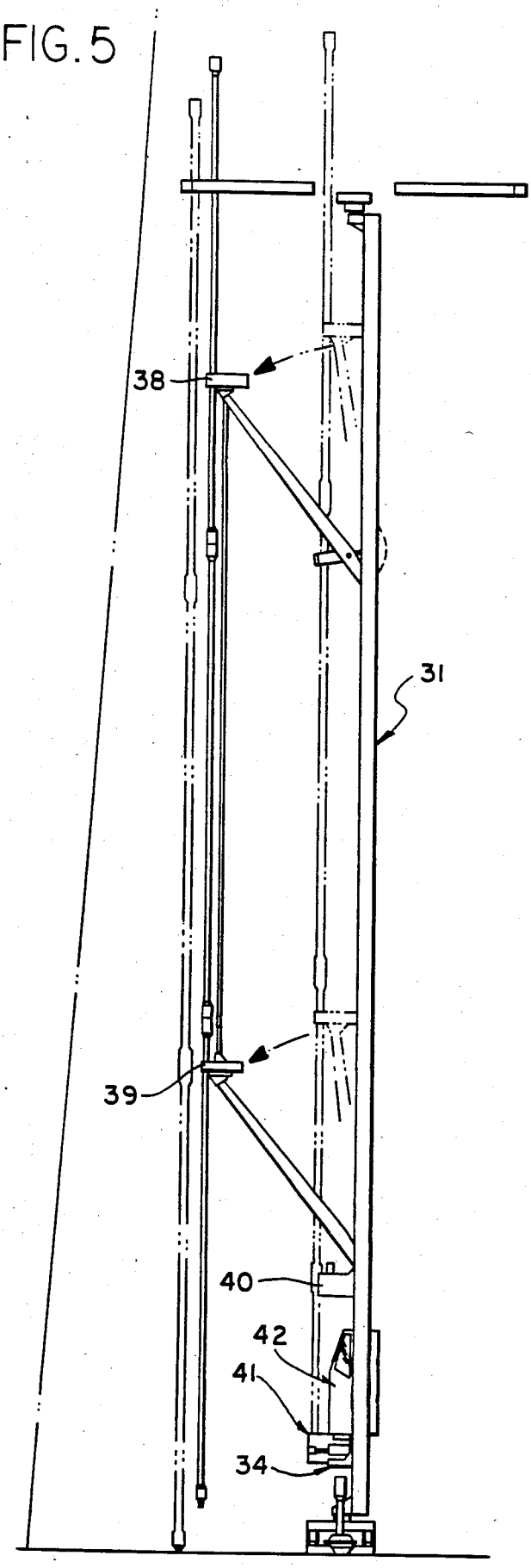
FIG. 5 is a view which may be considered as taken essentially on line 5—5 of FIG. 3, and showing the machine in a position for racking a pipe in that plane.
Figure 17:
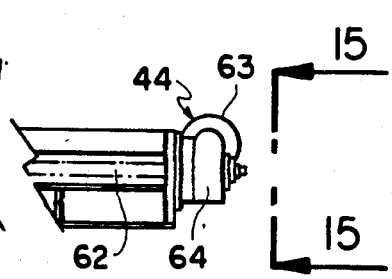
FIG. 17 is a horizontal section taken on line 17—17 of FIG. 13.

The control cab or control station 42 takes the form of a hollow compartment or chamber 129 (FIG. 12) within which an operator may sit on a seat 130 at a location to actuate controls 131. The operator can view torque wrench 41 and a pipe engaged thereby through a transparent window 132 located in the lower front portion of the cab. He also can view other portions of the mechanism through windows 133 in the upper portion of the cab, and can view video monitors 134 located within the cab and receiving signals from three video cameras 135, 136 and 137. Cameras 135 and 137 are carried by and move with the upper and lower pipe holding units 38 and 39 respectively and are aimed toward units 38 and 39 and any pipe held thereby in all positions of units 38 and 39, and produce pictures of the units and pipe on the corresponding monitors. Camera 136 is carried by and moves with column 31 and aimed to view the underside of the racking board and pipes held in one of the sides thereof when the column and cab are turned to face laterally toward that side of the racking board as represented in FIG. 5. Cab 42 is rigidly attached to and located above the third vertically movable carriage 34, which has rollers 138 engaging the rear sides of tracks **50*a* and rollers 139 engaging the front sides of those tracks to guide the lower carriage 34 and cab for only upward and downward movement along the tracks. Torque wrench 41 is also attached to carriage 34, at a location beneath the cab, for movement upwardly and downwardly with the carriage and cab. This torque wrench may be of essentially conventional construction, including an upper section 140 for engaging an upper one of two interconnected pipe joint ends, and a lower section 141 for engaging the lower of the two connected joint ends. As seen in FIG. 17 the upper section 140 includes two gripping jaws 142 which are connected pivotally together at 143 for actuation of their left ends as viewed in FIG. 17 toward and away from one another and between the broken line pipe gripping position of that figure and the full line open position. A piston and cylinder mechanism 144 received between the right ends of the jaw levers power actuates the jaws between their gripping and released conditions. In their open conditions, the jaws are far enough apart to allow the torque wrench to move between a position about the pipe and a position laterally offset therefrom. The lower section 141 of the torque wrench is essentially the same as upper section 140, as discussed above, including two jaws similar to jaws 142 of FIG. 7 and actuable between gripping and released conditions by a second piston and cylinder mechanism 145. After the torque wrench has been positioned at one of the joints of the pipe string, the upper section 140 of the torque wrench grips the lower end of one pipe section and the lower section 141 of the torque wrench engages the upper end of a second pipe section. The two sections of the torque wrench can then be turned relative to one another about axis 17 of the pipes to either break or make a threaded connection between the pipes. To attain this relative rotation, the torque wrench includes two additional piston and cylinder mechanisms 146** and 147, one of which has its cylinder connected to upper section 140 of the torque wrench and its piston connected to the lower section 141 of the torque wrench, and the other of which has its cylinder and piston connected in reverse to the two sections of the torque wrench, so that the piston and cylinder mechanisms 146 and 147 can power rotate the two sections of the torque wrench in either direction relative to one another and about the axis of the gripped pipe. The two sections 140 and 141 of the torque wrench are of course appropriately connected to the body of carriage 34 in a manner retaining them against vertical movement relative to the carriage and against horizontal displacement relative thereto from positions in which their gripping jaws are properly aligned with the vertical axis of spinner 40.

Carriage 34, cab 42 and torque wrench 41 are connected to the upper two carriages 32 and 33 by a vertically extending piston and cylinder mechanism 148 whose cylinder is rigidly attached to carriage 33 and whose piston rod 149 is connected at 150 to the upper end of the cab. This attachment allows the cab and torque wrench to move upwardly and downwardly with the upper parallelogram mechanism and related parts, and to also be actuable upwardly and downwardly by piston and cylinder mechanism 148 relative to carriage 33, carriage 32 and the paralleogram mechanism. The purpose of this relative vertical movement of the cab and torque wrench is to allow the torque wrench to be adjusted easily to a proper position for effective engagement with two connected joint ends to make or break a connection therebetween.

Figure 9:
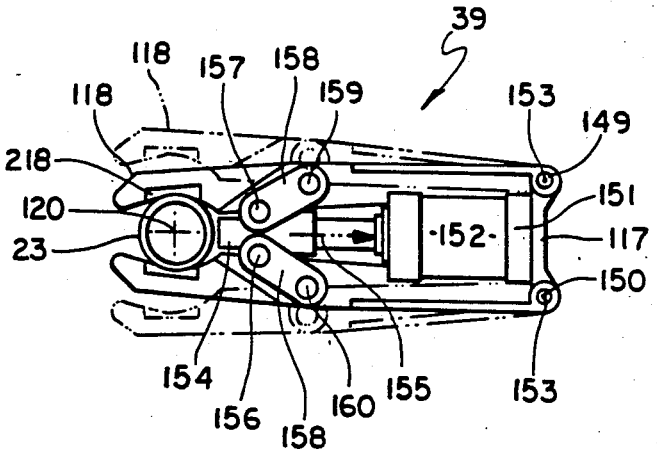

The lower pipe holding unit 39 is adapted to tightly grip pipe stand 23 in a manner both retaining it against rotation and supporting the pipe unit for lifting movement by unit 39. For this purpose, jaws 118 of unit 39 have gripping dies 218 with shoulders extending both vertically and horizontally to restrain rotary movement of the pipe and also support the weight of the entire pipe stand from unit 39. The two jaws 118 of the unit 39 are elongated and have their inner ends connected at 149 and 150 to the body 117 of unit 39 for swinging movement about two parallel vertical axes 153 between the full line gripping positions of FIG. 9 and the broken line open positions of that figure. The piston of a piston and cylinder mechanism 152 whose cylinder is rigidly attached to body 117 actuates a member 154 along a horizontal axis 155, with that member 154 being pivotally connected at 156 and 157 to two links 158, which are in turn pivotally connected at 159 and 160 to arms or jaws 118, in a relation swinging the jaws toward and away from one another in response to axial movement of the piston within unit 152. Rod 114 and the connected parts hold body 117 in a position in which the axes of pivotal connections 153 of jaws 118 extend directly vertically, and the axis 120 of gripping jaws 118 and of a pipe held thereby is directly vertical and aligned with axis 119 of the upper pipe holding unit and the axes of spinner 40 and torque wrench 41 in the FIGS. 1 and 7 inner position of arms 36 and 37.

Figure 8:
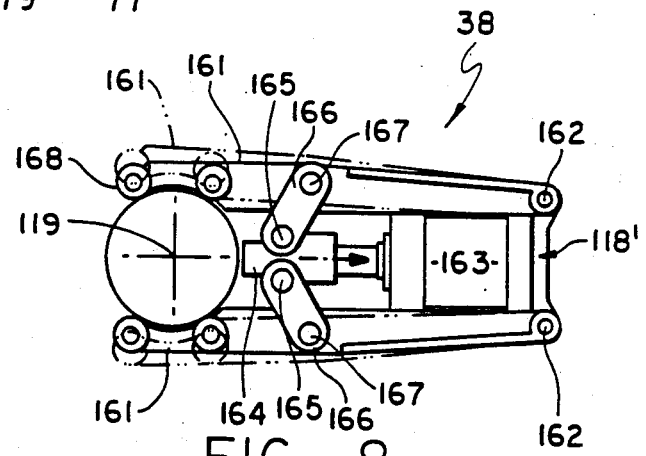

The upper pipe holding unit 38 (FIG. 8) is in some respects similar to the lower unit 39, but serves only to locate or center the engaged portion of the pipe while not preventing rotation thereof. Unit 38 has two arms 161 connected pivotally at 162 to the body 118′ of the unit 38 and to the cylinder of a piston and cylinder mechanism 163, to mount the arms for opening and closing movement between the full line and broken line positions of FIG. 8. A member 164 actuated by the piston of cylinder 163 is pivotally connected at 165 to a pair of links 166 whose opposite ends are pivoted at 167 to arms 161 to open and close the arms upon axial movement of the piston. Instead of gripping dies, jaw arms 161 carry rollers 168 which engage the pipe and turn about vertical axes parallel to the axis of the pipe to enable free rotation of the pipe about axis 119. In the closed position, rollers 168 engage and closely confine the pipe to maintain it in centered directly vertically extending condition with respect to axis 119, while in the open position of arms 161 the rollers are far enough apart to allow the pipe holding unit to move onto and off of the pipe. It will of course be understood that all of the pivotal and rotary axes in the linkages of FIGS. 8 and 9 extend directly vertically and parallel to one another to attain the discussed type of operation.

The racking board 24 is in some respects of conventional construction, including two structures 169 and 170 at opposite sides of the central portion 76 of the racking board, with each of those structures 169 and 170 having a series of parallel horizontal fingers 171 spaced apart far enough to receive within the guideway 172 formed between each pair of successive fingers the upper ends of a row of pipe stands. The passages or guideways 172 between the various fingers have their longitudinal axes 173 extending directly perpendicular to the previously mentioned radial plane 54 which contains the axes 61 and 79 of the synchronized lower and upper lead screw actuating mechanisms defining the direction of retracting movement of the column structure and a carried pipe. The pipes are retained within the guideways or passages 172 by two series of segmentally formed bars 174 (FIGS. 3 and 20), with these bars being actuated by two motors 175 and 176 under the control of the operator. As seen in FIG. 21, motor 175 drives a horizontal shaft 177 through a reduction gear assembly 178, and about that shaft there are located a series of sprocket like wheels 179 each having four projections 180 at evenly circularly spaced locations as seen in FIG. 20. Each bar 174 includes an articulated series of links 181 connected pivotally together at 182, with each link containing an opening adapted to receive one of the projections 180 of a corresponding one of the sprocket wheels 179 so that rotation of the sprocket wheels acts to advance the articulated bar longitudinally across the various pipe receiving guideway recesses or passages 172 of a corresponding one of the racking board sections 169 or 170. In a retracted position of each bar, all but an end one or two of the links of that bar hang downwardly as represented at 183 in FIG. 20. By counterclockwise rotation of the wheel 179 in FIG. 20 the links move successively to the left in the upper portion of FIG. 20 and across the various pipe receiving recesses or passages 172 between fingers 171. Each of the sprocket wheels 179 is rotatable about shaft 177, and can be releasably keyed to the shaft for rotation therewith by actuation of an individual clutch 184 associated with the sprocket wheel, and be retained against rotation by a brake 185. An operator in the control cab can actuate any one of the clutches to cause advancement of any of the bars for retaining a corresponding one of the stored pipes in the rack, and upon release of the clutch the associated brake 185 acts to automatically lock the bar in that setting until subsequently actuated again for retention of another pipe in a next successive one of the pipe racking recesses 172.

Figure 3:
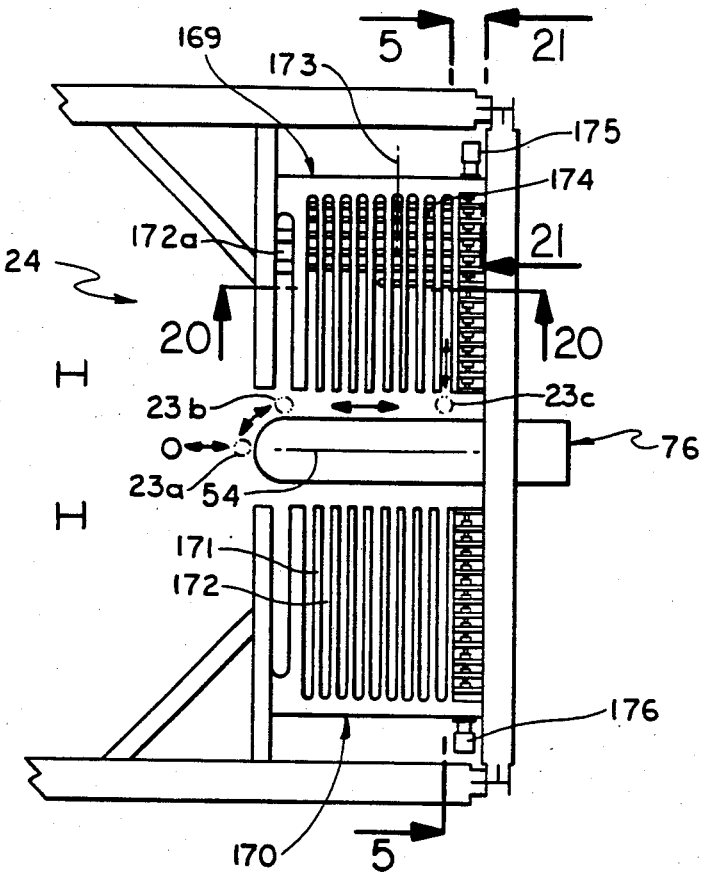
FIG. 3 is an enlarged fragmentary plan view of the pipe racking board area taken on line 3—3 of FIG. 1.
Figure 4:
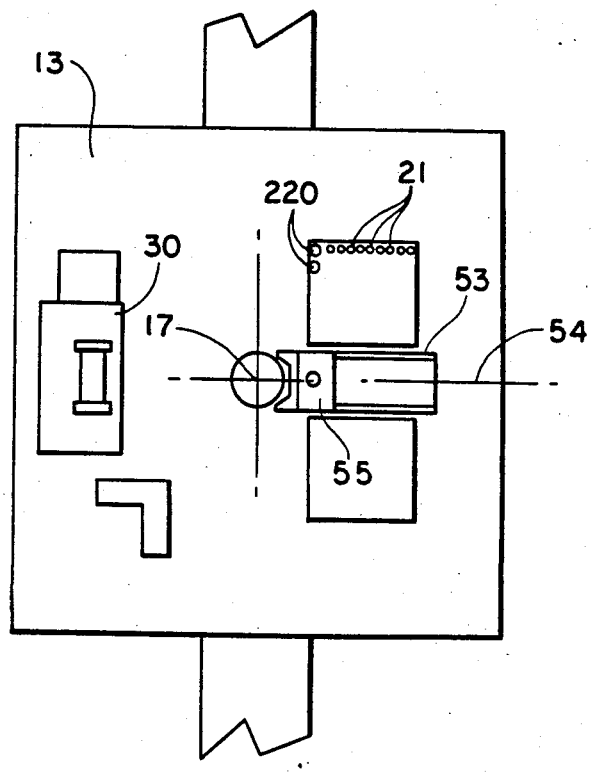
FIG. 4 is a somewhat diagrammatic representation of the rig floor, taken on line 4—4 of FIG. 1.

The pipe receiving guideways 172*a* at the left ends of the two sections 169 and 170 of the racking board assembly as viewed in FIG. 3 are wider than the other guideways, to receive drill collars which are of greater diameter than the other pipe sections of a drill string. To allow room for these increased diameter drill collars, only alternate ones of the bars 174 are utilized to extend across guideways 172*a*, with these bars being engageable at the end of their travel with gate members 186 pivoted at 187 for swinging movement between the full line inactive position of FIG. 20 and the broken line active position of extension across the guideway. The end segment of the bar engages the right side of element 186 as viewed in FIG. 20, and deflects that element to its broken line position. Intermediate ones of the bars do not have a gate element 186 associated therewith, to thus leave spaces wide enough for reception of the increased diameter drill collar sections.

The remotely controlled elevator 25 (FIGS. 18 and 19) includes a rigid body 188 adapted to extend entirely about a pipe stand and having loops 189 at diammetrically opposite locations for engagement with the suspending links 26 in a manner holding the body of the device with its axis 190 in a directly vertical condition. Four slips 191 are contained within the body at circularly spaced locations, and are actuable vertically between the broken line retracted position of FIG. 19 and the full line active position of that figure. In the broken line position, the slips are retracted upwardly and radially outwardly far enough to allow the tool joints of a pipe string to move upwardly and downwardly through the elevator, while in the active full line position of the slips, their inclined upwardly facing inner surfaces 192 are engageable with the downwardly facing inclined shoulder surfaces 193 on the tool joints to support a stand of the pipe string from the elevator. A lower throat 194 in the body of the elevator assists in stabbing the elevator relative to the upper end of a section of pipe.

Two piston and cylinder mechanisms 195 at diammetrically opposite sides of the elevator body 188 actuate the slips upwardly and downwardly between their gripping and released positions. For this purpose, the cylinder 196 of each piston and cylinder mechanism 195 is formed as a portion of a member 197 containing two latch elements 198 which connect the associated slips to member 197 for movement upwardly and downwardly therewith. Each element 198 has a cylindrical shank 199 received slidably within a radially extending passageway 200 in member 197 and guided thereby for movement radially inwardly and outwardly with respect to the vertical axis 190 of the elevator. An enlarged head 202 at the inner end of shank 199 of element 198 is received within a recess 203 in the corresponding slip, to locate the slip relative thereto, while a spring 204 acts against an outer head 205 of latch element 198 to yieldingly urge the latch element and the connected slip radially outwardly. Thus, when the slip is in its upper position, spring 204 holds it outwardly against body 188 and in its retracted condition, and prevents unintentional downward movement of the slip until it is forcibly actuated downwardly by the piston and cylinder mechanism 195. Upon such downward actuation, two vertically spaced sets of camming surfaces 205 on the slip and body 188 cause the slip to be actuated radially inwardly for supporting engagement with a drill pipe. The piston rod 206 of each piston and cylinder mechanism 195 may be double-ended and connect at both its upper and lower ends to ears 207 of body 188. The axis 208 of the piston and cylinder mechanism extends vertically and parallel to axis 190 to attain the desired upward and downward actuation of the slips.

Figure 22:
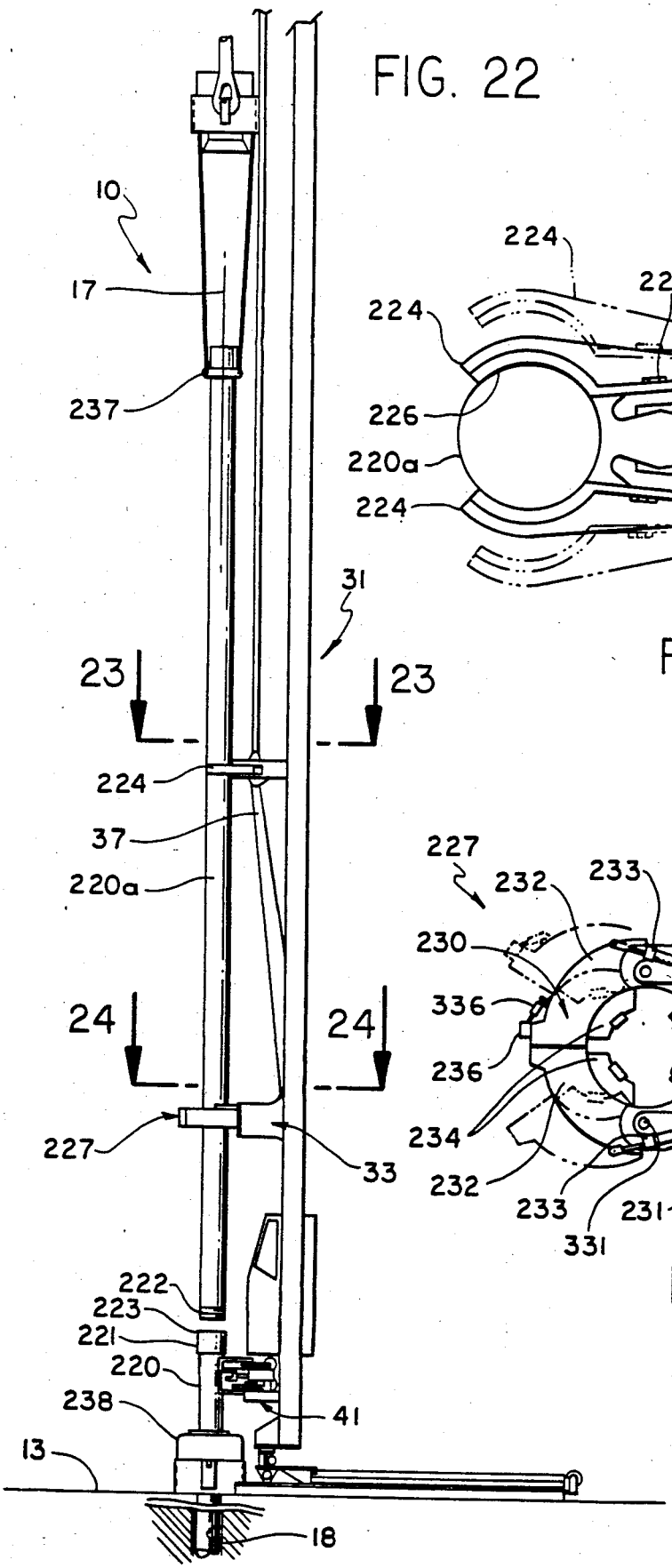
FIG. 22 is a fragmentary view similar to FIG. 1, but showing the machine as utilized for running a string of casing into the well.
Figure 23:
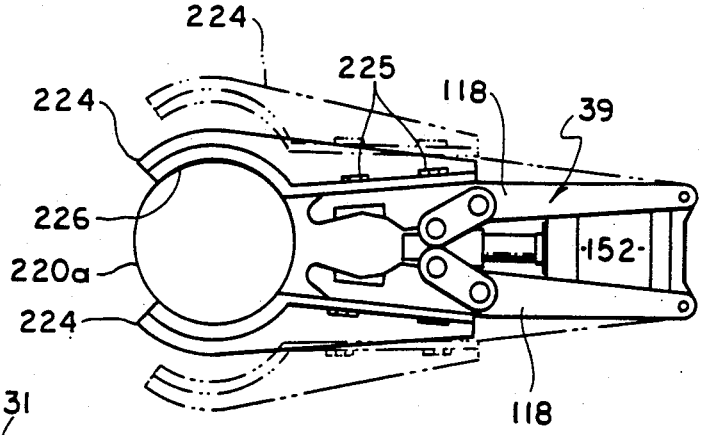
FIGS. 23 and 24 are enlarged horizontal sectional views taken on lines 23—23 and 24—24 respectively of FIG. 22.
Figure 24:
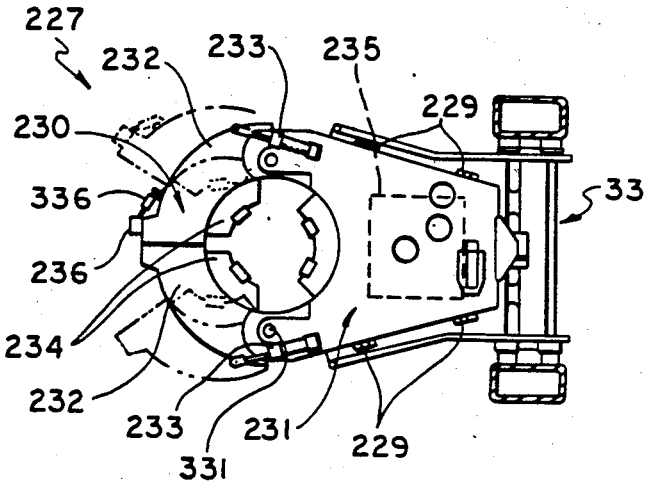

FIGS. 22 through 24 show the machine 10 as it appears when utilized for assisting in the lowering of a string of casing 220 into a well 18. During this process, the machine functions to hold a section of casing 220*a* in vertical alignment with the upper ends 221 of the casing string already in the hole, and rotates section 220*a* to screw its lower externally threaded end 222 into the upper internally threaded box end 223 of the string. In FIG. 22, the column structure 31 and carried parts are retracted a short distance to the right of their FIG. 1 position, so that the upper drill pipe holding unit 38 and torque wrench 41 are retracted far enough to the right to avoid contact with the casing. For gripping the casing at an upper location, two jaws 224 are rigidly attached to the jaws 118 of unit 39 of the machine, and project leftwardly therebeyond as viewed in FIGS. 22 and 23. These jaws 224 may be attached to jaws 118 in any convenient manner, as by fasteners represented diagrammatically at 225, to be actuable with the jaws 118 by piston and cylinder mechanism 152 between the full line casing gripping condition of FIG. 23 and the broken line open condition of that figure. Jaws 224 have inner cylindrically curved complementary surfaces 226 which are curved in correspondence with the outer surface of casing section 220*a* and are adapted to grip the casing in a manner locating it against horizontal movement while at the same time permitting rotation of the casing relative to jaws 224, and also permitting vertical movement of the casing relative to those jaws.

At a location spaced beneath unit 39 and the attached jaws 224, the casing is engaged and rotated by a powered casing tong 227 which is mounted to carriage 33 at the lower end of arm 37. When the apparatus is to be used for lowering casing, the spinner 40 is removed from carriage 33, by removing the fasteners 228 securing the spinner to the carriage, and the power driven tong 227 is then attached to carriage 33 by fasteners represented diagrammatically at 229. Tong 227 may be of known conventional construction including a body 230 formed of a main section 231 and two outer jaws 232 connected to body 231 pivotally at 331 for swinging movement relative thereto between the closed full line positions of FIG. 24 and the open broken line positions in which a section of casing can move into and out of the tong. In the closed condition, gripping elements 234 of the tong engage and grip the casing and rotate it about the vertical axis 17 of the casing to make or break a threaded connection at its lower end when the gripping elements are driven rotatively about axis 17 by a remotely controlled motor represented at 235. Jaws 231 may be opened and closed by piston and cylinder mechanisms 233, and may be releasably locked in closed condition by a latch mechanism 236 operated by a piston and cylinder mechanism 336. The casing stand is suspended and lowered into engagement with the upper box end 221 of the casing string by an elevator 237 suspended from the traveling block 27.

To describe now a cycle of operation of the machine, assume that the entire drill string is initially in the well, and that it is desired to remove the string from the well and sequentially stack stands of three pipes in the racking board area. During the drilling operation the column structure 31 of the pipe handling machine is in the stand-by position represented in broken lines at 31' in FIG. 1, in which pipe handling units 38 and 39, spinner 40 and torque wrench 41 are all retracted laterally away from engagement with the pipe string. The limit of the range of swinging movement of arms 36 and 37 is such that in their extreme inner positions of FIG. 1 the pipe holding units 38 and 39 have their axes directly vertically aligned with the axes of spinner 40 and torque wrench 41, so that all of these units are located for simultaneous engagement with a stand of pipe when the column structure is actuated inwardly to the full line position of FIG. 1. Before such actuation of the machine from its stand-by condition, elevator 25 is lowered downwardly about the upper end of the upper stand of pipe, and the slips of the elevator are actuated downwardly under the remote control of the drawworks operator actuating a valve 209 for delivering pressurized fluid to the cylinders of the elevator to move their slips downwardly. The slips are then in condition to grip the drill pipe and enable the elevator to lift the string to the FIG. 1 position. After the elevator and string have been hoisted to that position, slip assembly 15 can be set to engage the string just beneath the upper three section stand and support the string in the well. The elevator may then be remotely released and pulled upwardly away from the string, after which the operator actuates a switch 210 in cab 42 to energize motors 63 and 80 simultaneously and in unison to move the upper and lower ends of the column structure 31 leftwardly in precisely synchronized relation, and to the full line position of FIG. 1, in which the column structure remains directly vertical and the various vertically aligned units 38, 39, 40 and 41 are all received about the pipe stand. The jaws are of course all fully opened during such leftward movement of the column structure and carried parts to enable the different units 38, 39, 40 and 41 to thus move about the pipe. The leftward end of the horizontal stroke of the column structure is precisely determined to accurately locate units 38, 39, 40 and 41 at exactly at the well center line, with a stop limiting leftward movement in that position and thus avoiding any requirement for precise control of the positioning of the column by the operator. By actuation of another switch or valve 211 in the control cab, the operator actuates piston and cylinder mechanism 148 to move the cab and torque wrench upwardly or downwardly as necessary to bring the upper and lower sections of the torque wrench into proper engagement with the lower end of one pipe section and the upper end of another pipe section. If necessary, this movement may be supplemented by actuation of piston and cylinder mechanism 127 to move all of the carriages upwardly and downwardly along the column structure. The operator then actuates an additional control valve or switch 212 in the cab to close the jaws of the torque wrench 41 and cause the torque wrench to forcibly rotate the joint end engaged by its upper section in a counterclockwise direction relative to the connected joint end engaged by its lower section in order to break the threaded connection at that location. The torque wrench may then be opened after which the jaws of spinner 48 may be closed and the motors of that spinner actuated by operation of another switch or switches 213 in the cab to cause the spinner to grip and rapidly rotate stand 23 relative to the remainder of the string to complete the disconnection of that stand from the string. At the time that the spinner is clamped on the pipe, the operator actuates another switch or valve 214 in the cab to close the jaws of upper pipe holding unit 38 in a manner enabling that unit to locate the upper portion of the stand and hold it in proper position while the spinner unscrews it from the upper end of the string. After the stand has been spun out, the operator actuates another valve or switch 215 in the cab to close the jaws of the lower pipe holding unit 39 tightly enough on the stand to lift the stand, with vertical movement thereof being attained by actuating piston and cylinder mechanism 127 to pull the various carriages 32, 33 and 34 and connected parts upwardly far enough to move the lower end of the stand completely out of the upper box end of the remainder of the drill string.

With the stand elevated in this manner, the operator again actuates motors 63 and 80 in unison to retract the column structure and supported stand rightwardly toward the stand-by broken line position of FIG. 1, but with the stand and connected parts elevated slightly above their FIG. 1 position as discussed. During such retraction, the driller may begin lowering the elevator to pick-up a next successive stand for removal by the machine. When the column structure 31 reaches the retracted broken line stand-by position of FIG. 1, or prior thereto if desired, the operator actuates a switch or valve 216 in the cab to energize rotary drive 45 at the bottom the column structure, and pivot the column and the carried parts including the suspended stand 23 through 90° about axis 46, to thus swing the stand to one side of the central portion 76 of the racking board assembly 24, as from the position represented at **23*a* in FIG. 3 to the position represented at 23*b* in that figure. The rightward travel of the column structure and carried parts is continued beyond the position 23*b* of the stand and until the stand reaches a position opposite a particular one of the pipe receiving guideways 172 in the racking board assembly within which that particular stand is to be located. For example, a first stand would normally be moved to a location opposite the guideway 172 which is located to the extreme right in FIG. 3, as to the position represented at 23*c* in that figure. The operator then releases the spinner and actuates a switch or valve 217 in the cab causing delivery of pressure fluid to piston and cylinder mechanism 94 acting to swing arms 36 and 37 and the two pipe holding units 38 and 39 and the stand supported thereby from the broken line position of FIG. 5 to a position such as that represented in full lines in that figure. During this swinging movement of the arms and the remainder of the parallelogram mechanism, the pipe moves downwardly as it moves laterally, and this movement continues until the stand reaches the end of the guideway 172 or contacts a previously inserted stand in that same guideway. When the stand reaches this proper location, the operator actuates a control 218 in the cab to actuate one of the motors 175 or 176 and one of the clutch and brake assemblies 184–185 to move one of the bars 174 far enough to cross that particular guideway 172 and lock the stand in position in that guideway. With the stand properly located, the operator actuates piston and cylinder mechanism 127 to lower carriages 32, 33 and 34 and the stand until the stand engages the rig floor. The pipe holding units 38 and 39 are then opened remotely by the operator, piston and cylinder mechanism 94 is actuated to swing the arms to their retracted positions in which the movement is limited by the locating stops, and the machine is brought back to the stand-by position by shifting the column leftwardly and pivoting the column structure about axis 46**. The procedure can then be repeated for each succeeding stand until all of them have been stored in the racking board assembly.

The procedure for returning the string back into the well is in most respects the reverse of that discussed above. The machine is first lined up with a selected one of the guideways 172 of the racking board assembly, and the arms 36 and 37 are then extended until pipe holding units 38 and 39 contact the stand and stop. These holding units are then closed and clamped about the stand, and the stand is raised off of the floor by elevation of the carriages and connected mechanism relative to the column structure. The arms and carried pipe stand are then swung to the fully retracted position, the torque wrench is vertically adjusted to a position in which its upper section engages the lower pin end of the stand, and the spinner is clamped on the stand. The machine is shifted horizontally as far as the stand-by position and rotated through 90° toward the well center line, where it may wait if the string is not yet in proper position for reception of the stand. After the string which is already in the hole has been lowered to a position near the rig floor and suspended by the slip mechanism 15, the operator can move column structure 31 and the supported stand to the well center line above the upper end of the drill string, after which the carriages 32, 33 and 34 can be lowered to move the stand downwardly into engagement with the upper end of the string, so that the spinner 40 can advance the stand rotatably into the upper box end of the string, and torque wrench 41 can be actuated to make up the connection tightly. An automatic interlock represented diagrammatically at 219 between the lower pipe holding unit 39 and spinner 49 acts to automatically release unit 39 from its clamped condition of engagement with the pipe stand when the spinner is energized, to thus allow the spinner to turn the pipe. The upper pipe holding unit 38 assists in locating the pipe during the spinning and torqueing operation. After the stand has been completely connected to the string, the operator can engage elevator 25 with the upper end of the added stand, and with all of the jaws of units 38, 39, 40 and 41 opened, column structure 31 and the carried parts can be retracted to the stand-by position and then shifted pivotally and horizontally to a position for picking up the next successive stand from the racking board assembly.

When the machine is to be utilized for lowering a string of casing into the well 18, jaws 224 are connected to pipe holding unit 39 in the relation illustrated in FIGS. 22 and 23, spinner 40 is removed from carriage 33, and the power driven casing tong 227 is attached to carriage 33. The column structure 31 is retracted rightwardly a short distance from the FIG. 1 position and to the position of FIG. 22 in which the casing gripping portions of jaws 224 and casing tong 227 are centered about and aligned with vertical axis 17 of the well. Jaws 224 may be opened to their broken line position of FIG. 23, and gripping elements 234 of casing tong 227 may be retracted radially outwardly to their open positions in which elevator 237 and a suspended stand **220*a* of casing may be lowered along axis 236 and downwardly into the casing tong 227 to a position such as that represented in FIG. 22. Jaws 224 may then be closed to grip the casing sufficiently tightly to effectively and positively locate it against horizontal movement while at the same time allowing rotary and vertical movement of the casing in that centered position. The actuating motor or mechanism 235 of the casing tong is then energized by the operator in cab 42 to tightly grip the casing section 220*a* and rotate it for connection of its lower threaded end 222 to box end 221 of the casing string. The tong may be adapted to allow downward movement of the casing section during completion of this threaded connection, to allow the threads 222 to advance into box 221. It is also contemplated that if desirable the carriage 33** may be lowered with the casing stand during completion of the threaded connection.

While the casing section **220*a* is being added to the upper end of string 220, the string is supported by a slip assembly 238 mounted in the rig floor 13. After the section 220*a* has been attached to the string, this slip assembly 238 may be released to allow downward movement of the string, and elevator 237 can be lowered to advance section 220*a* into the well. Casing tong 227 may be opened and column structure 31 moved to the right until the upper end of section 220*a* is just above slip assembly 238, at which point the slip assembly may be actuated to support the string so that the elevator can be detached from section 220*a*** to pick up a next successive casing section. The above discussed steps are then repeated to add that section to the string, and the process is continued until a desired length of casing has been lowered into the well.

While a certain specific embodiment of the present invention has been disclosed as typical, the invention is of course not limited to this particular form, but rather is applicable broadly to all such variations as fall within the scope of the appended claims.

I claim:

1. A well pipe handling machine for use in a rig having a string of pipe extending vertically along an axis of a well and having a rack for receiving and holding aseries of pipe sections from said string in essentially vertically extending condition, comprising:

a vertically extending support column structure;

two pipe holding units carried by said support column structure at vertically spaced locations and adapted to engage a vertically extending section of pipe at vertically spaced locations and support the pipe in vertical condition;

means for moving said support column structure carrying said pipe holding units and a pipe section held thereby between a first position in which said units hold the pipe section in vertical condition in alignment with said axis of the well and a second position in which the column structure remains in vertically extending condition but is offset horizontally from the first position and said units can move the pipe section in vertical condition into or out of said rack;

a carriage structure mounted to said column structure for movement upwardly and downwardly relative thereto;

a parallelogram mechanism mounting said two pipe holding units to said carriage structure for movement upwardly and downwardly therewith and including two similar swinging arms carrying said pipe holding units respectively and connected to said carriage structure for swinging movement in unison relative thereto to move the pipe holding units and a carried pipe generally horizontally toward and away from said column structure while retaining the pipe in essentially vertical condition;

a control station connected to said carriage structure for movement upwardly and downwardly therewith and with said swinging arms and pipe holding units and adapted to hold an operator and having controls for controlling operation of the machine;

a torque wrench connected to said carriage structure for movement upwardly and downwardly therewith and for movement with the carriage structure and the column structure between said first and second positions of the latter, and adapted to connect a pipe section to said pipe string or disconnect the pipe section therefrom; and a spinner connected to said carriage structure for movement upwardly and downwardly therewith and for movement with the carriage structure and the column structure between said first and second positions of the latter and adapted to rotate a pipe section relative to said string.

2. A well pipe handling machine as recited in claim 1, including means for actuating said torque wrench upwardly and downwardly relative to said parallelogram mechanism.

3. A well pipe handling machine as recited in claim 1, including means for actuating said torque wrench upwardly and downwardly relative to said parallelogram mechanism and said spinner.

4. A well pipe handling machine as recited in claim 1, in which said means for moving said column structure include two synchronized powered drives for actuating upper and lower portions of said column structure in unison toward and away from said axis, and means for pivoting said column structure about a vertical axis through 180° to face in either of two opposite directions for moving a series of pipes to different storage locations.

5. A well pipe handling machine as recited in claim 4, in which said carriage structure includes a first carriage carrying a first of said swinging arms, a second carriage spaced beneath said first carriage and carrying a second of said swinging arms, a connector extending vertically between said two carriages and attaching them together for movement in unison, a third carriage spaced beneath said second carriage and mounting said control station and torque wrench for upward and downward movement, and a connection attaching said third carriage to said second carriage for movement therewith.

6. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said piep holding means between a first position in which the support column structure extends essentially vertically and said pipeholding means support said pipe section in vertical condition in alignment with said axis of the well and a second position in which said column structure remains in essentially vertically extending condition but is offset horizontally from said first position and in which said pipe holding means are operable to move a pipe supported thereby in vertical condition into or out of said rack;

means for shifting said pipe holding means and a vertical pipe supported thereby vertically p arallel to said axis relative to said column structure;

a control station for holding an operator and which is carried by said column structure for movement therewith between said first and second positions, and is mounted for movement upwardly and downwardly relative to said column structure;

a torque wrench carried by said column structure for movement therewith between said first and second positions and adapted to make and a break a connection between a pipe section and said pipe string; and a spinner carried by said column structure for movement therewith between said first and second positions adapted to power rotate a pipe section relative to the string.

7. A well pipe handling machine as recited in claim 6, in which said means for shifting said pipe holding means vertically are operable to actuate said control station and said torque wrench and said spinner upwardly and downwardly with the pipe holding means.

8. A well pipe handling machine as recited in claim 7, in which said pipe holding means include two vertically spaced pipe holding units, there being means for power actuating said two pipe holding units toward and away from said support column structure and between a position of vertical alignment with said torque wrench and spinner and a position offset horizontally with respect to the torque wrench and spinner.

9. A well pipe handling machine as recited in claim 8, including means for actuating said torque wrench upwardly and downwardly relative to said pipe holding means and said spinner.

10. A well pipe handling machine for use in a rig having a string of pipe extending vertically along an axis of a well, comprising:

a movable support;

pipe holding means carried by said support for movement therewith and adapted to hold a section of pipe in vertical condition;

means for moving said support carrying said pipe holding means and a pipe section held thereby between a first position in which the pipe holding means hold said pipe section in vertical condition in alignment with said axis of the well and a second position in which said pipe holding means locate said pipe section in vertical condition at a storage location offset from said axis;

a control station for holding an operator and which is carried by said support for movement therewith between said first and second positions of the support; and a pipe rotating unit carried by said support for movement therewith and with said contorl station between said first and second positions.

11. A well pipe handling machine as recited in claim 10, in which said pipe holding means include two vertically spaced and vertically aligned pipe holding units for engaging and holding a pipe at vertically spaced locations, there being a parallelogram mechanism including two similar arms carrying said two pipe holding units respectively and including powered means for swinging said arms in unison relative to said support to move said units in uhison toward and away from said support while holding a pipe in vertical condition, and between a position in which said units are alinged vertically with said pipe rotating unit and a position offset horizontally with respect thereto.

12. A well pipe handling machine as recited in claim 11, in which said means for moving said support include two synchronized drives engaging said support near upper and lower ends respectively thereof and operable to move said upper and lower ends in unison toward and away from said axis, and means for power rotating said support pivotally about a second vertical axis to face in a predetermined direction at said storage location.

13. A well pipe handling machine as recited in claim 10, in which said pipe rotating unit is a torque wrench.

14. A well pipe handling machine as recited in claim 10, in which said pipe rotating unit is a spinner.

15. A well pipe handling machine for use in a rig having a string of pipe extending vertically along an axis of a well, comprising:

a movable support;

pipe holding means carried by said support for movement therewith and adapted to hold section of pipe in vertical condition;

means for moving said support carrying said pipe holding means and a pipe section held thereby between a first position in which the pipe holding means hold and pipe section in vertical condition in alignment with said axis of the well and a second position in which said pipe holding means locate said pipe section in vertical condition at a storage location offset from said axis;

a control station for holding an operator and which is carried by said support for movement therewith between said first and second positions of the support;

a torque wrench carried by said support for movement with it and with said control station and pipe holding means between said first and second positions; and a spinner carried by said support for movement therewith and with said control station and pipe holding means and torque wrench between said first and second positions.

16. A well pipe handling machine as recited in claim 15, including a means for moving said control station and said torque wrench and said spinner upwardly and downwardly relative to said support.

17. A well pipe handling machine as recited in claim 16, including means for moving said torque wrench and said control station upwardly and downwardly relative to said spinner and said pipe holding means.

18. A well pipe handling machine as recited in claim 15, including means for moving said pipe holding means and said control station and said torque wrench and said spinner upwardly and downwardly relative to said support.

19. A well pipe handling machine as recited in claim 15, in which said torque wrench is carried by said support at essentially the lower end of said control station.

20. A well pipe handling machine as recited in claim 15, in which said spinner is carried by said support at essentially the upper end of said control station.

21. A well pipe handling machine as recited in claim 15, in which said pipe holding means include two vertically spaced and vertically aligned pipe holding units for engaging and holding a pipe at vertically spaced locations, there being a parallelogram mechanism including two similar arms carrying said two pipe holding units respectively and including powered means for swinging said arms in unison relative to said support to move said units in unison toward and away from said support while holding a pipe in vertical condition, and between a position in which said units are aligned vertically with said torque wrench and said spinner and a positon offset horizontally with respect thereto.

22. A well pipe handling machine as recited in claim 21, in which said means for moving said support include two synchronized drives engaging said support near upper and lower ends respectively thereof and operable to move said upper and lower ends in unison toward and away from said axis, and means for power rotating said support pivotally about a second vertical axis to face in either of two opposite directions at said storage location, and a lock element movable to a position releasably blocking pivotal movement of the support from intermediate position facing toward said first mentioned axis.

23. A well pipe handling machine as recited in claim 21, including means for actuating said parallelogram mechanism upwardly and downwardly relative to said support.

24. A well pipe handling machine as recited in claim 23, including means connecting said control station and said torque wrench and said spinner to said parallelogram mechanism for movement upwardly and downwardly therewith relative to said support.

25. A well pipe handling machine as recited in claim 24, including means for actuating said control station and said torque wrench upwardly and downwardly relative to said support and said parallelogram mechanism and said pipe handling units.

26. A well pipe handling machine as recited in claim 25, in which said means for moving said support include two synchronized drives engaging said support near upper and lower ends respectively thereof and operable to move said upper and lower ends in unison toward and away from said axis, and means for power rotating said support pivotally about a second vertical axis to face in a predetermined direction at said storage location.

27. A well pipe handling machine as recited in claim 15, in which said pipe holding means include two vertically spaced and vertically aligned pipe holding units for engaging and holding a pipe at vertically spaced locations, there being a parallelogram mechanism including two similar arms carrying said two pipe holding units respectively and including powered means for swinging said arms in unison relative to said support to move said units in unison toward and away from said support while holding a pipe in vertical condition, and between a position in which said units are aligned vertically with said torque wrench and said spinner and a position offset horizontally with respect thereto, two cameras carried by said two pipe holding units respectively for movement therewith and adapted to a view a pipe held by said units in different positions thereof, and monitor means carried by said control station and presenting to an operator representations of pipe held by said units as viewed by said cameras.

28. A well pipe handling machine as recited in claim 27, including an additional camera carried by said support for movement therewith and aimed to view a rack for receiving pipe in said second position of the support and present a picture of the rack on said monitor means.

29. A well pipe handling machine for use in a rig having a floor and having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

two vertically spaced pipe holding units carried by said support column structure for movement therewith and adapted to hold a section of pipe in vertical condition during such movement;

upper and lower carriage structures connected to upper and lower ends respectively of said column structure;

two synchronized drive mechanisms for actuating said carriage structures genrally horizontally in correspondence with one another between a first position in which the support column structure extends essentially vertically and said pipe holding units support said pipe section in vertical condition in alignment with said axis of the well and a second position in which said support column structure remains in essentially vertically extending condition but is offset horizontally from said first position and said pipeholding units can move a pipe supported thereby in vertical condition into or out of said rack;

pivotal connections attaching upper and lower ends of said column structure to said upper and lower carriage structures repsectively for pivotal movement about a vertical axis offset from the axis of said well to face said rack;

powered means for pivoting said column structure relative to said two carriage structures;

tracks adapted to extend horizontally along said rig floor and guide said lower carriage structure between said first and second positions;

a third carriage structure mounted to said column structure for movement upwardly and downwardly relative thereto and for movement with said column structure pivotally and between said first and second positions thereof;

means for actuating said third carriage structure upwardly and downwardly;

a parallelogram mechanism mounting said two pipe holding units to said third carriage structure for movement upwardly and downwardly therewith relative to the column structure and for movement with the column strucutre between said first and second positions thereof;

said parallelogram mechanism including two swinging arms carrying said pipe holding units respectively and connected to said third carriage structure at vertically spaced locations for swinging movement in unison relative thereto to move the pipe holding units and a carried pipe generally horizontally toward and away from said column structure while retaining the pipe in essentially vertical condition;

actuating means for swinging said arms in unison;

a control station for carrying an operator and having controls for operating the machine, and which control station is connected to said third carriage structure for movement therewith upwardly and downwardly and pivotally and between said first and second posoitions;

a torque wrench connected to said third carriage structure for movement therewith and located near said control station; and a spinner connected to said third carriage structure for movement therewith and located above and in alignment with said torque wrench.

30. A well pipe handling machine as recited in claim 24, including means for actuating said control station and said torque wrench upwardly and downwardly relative to said parallogram mechanism and said pipe holding units.

31. A well pipe handling machine for use in a rig having a string of pipe extending vertically along an axis of a well, comprising:

a movable support column structure;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means are operable to move a pipe supported thereby in vertical condition into or out of a rack;

a powered unit which is operable to engage and rotate a vertical pipe relative to said string, and which unit is mounted to said column structure for movement therewith between said first and second positions of the column structure;

said pipe holding means including two vertically spaced and vertically aligned pipe holding units for engaging and holding a pipe at vertically spaced locations; and a parallelogram mechanism including two similar arms carrying said two pipe holding units respectively and mounted for swinging movement in unison relative to said column structure to move said units in unison toward and away from said column structure while holding a pipe in vertical condition, and between a position in which said units are aligned vertically with said powered unit and a position offset horizontally with respect thereto.

32. A well pipe handling machine as recited in claim 31, including means for actuating said parallelogram mechanism and said pipe holding units and said powered unit upwardly and downwardly relative to said column structure.

33. A well pipe handling machine as recited in claim 31, including means for actuating said parallelogram mechanism and said pipe holding units upwardly and downwardly relative to said column structure.

34. A well pipe handling machine as recited in claim 31, including means for actuating said powered unit upwardly and downwardly relative to said column structure.

35. A well pipe handling machine as recited in claim 31, in which said means for moving said support column structure include two synchronized drives engaging said column structure near upper and lower ends respectively thereof and operable to move said upper and lower ends of the column strucutre in unison toward and away from said axis, and means for power rotating said column structure pivotally about a second vertical axis to face in a predetermined direction toward said rack.

36. A well pipe handling machine as recited in claim 35, including means for actuating said parallelogram mechanism and said pipe holding units upwardly and downwardly relative to said column structure.

37. A well pipe handling machine for use in a rig having a string of pipe extending vertically along an axis of a well, comprising:

a movable support column structure;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column strucutre remains in essentially vertically extending condition but is offset horizontally from said first position and in which said pipe holding means are operable to move a pipe supported thereby in vertical condition into or out of a rack;

a torque wrench which in operable to engage and rotate a vertical pipe relative to said string, and which is mounted to said column structure for movement therewith between said first annd second positions of the column structure;

a spinner carried by said column structure for movement therewith between said first and second positions thereof and operable to rotate a pipe section relative to said string;

said pipe holding means including two vertically spaced and vertically aligned pipe holding units for engaging and holding a pipe at vertically spaced locations; and a parallelogram mechanism including two similar arms carrying said two pipe holding units respectively and including powered means for swinging said arms in unison relative to said column strucutre to move said units in unison toward and away from said column structure while holding a pipe in vertical condition, and between a position in which said units are aligned vertically with said torque wrench and spinner and a position offset horizontally with respect thereto.

38. A well pipe handling machine as recited in claim 37, including means for actuating said parallelogram mechansim and said torque wrench and said spinner upwardly and downwardly relative to said support column structure.

39. A well pipe handling machine as recited in claim 38, including means for acctuating said torque wrench upwardly and downwardly relative to said pipe holding units and said parallelogram mechanism.

40. A well pipe handling machine as recited in claim 39, in which said means for moving said support column structure include two synchronized powered drives for actuating upper and lower portions of said column structure in unison toward and away from said axis, and means for pivoting said column structure about a vertical axis through 180? to face in either of two opposite directions for moving a series of pipes to different storage locations.

41. A well pipe handling machine as recited in claim 37, including means for actuating said parallelogram mechanism and said pipe holding units upwardly and downwardly relative to said column structure.

42. A well pipe handling machine for use in a rig having a string of pipe extending vertically along an axis of a well, comprising:

a movable support column structure;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with asid axis of the well and a second position in which said column structure remains in essentially vertically extending condition but is offset horizontally from said first position and in which said pipe holding means are operable to move a pipe supported thereby in vertical condition into or out of a rack; and a powered unit which is operable to engage and rotate a vertical pipe relative to said string, and which unit is mounted to said column strucutre for movement therewith between said first and second positions of the column structure;

said means for moving said support column structure including two synchronized drives engaging said column structure near upper and lower end respectively thereof and operable to move said upper and lower ends of the column structure in unison toward and away from said axis, and means for power rotating said column structure pivotally about a second vertical axis to face in a predetermined direction toward said rack.

43. A well pipe handling machine as recited in claim 42, including means for actuating said powered unit upwardly and downwardly relative to said column structure.

44. A well pipe handling machine as recited in claim 42, including means for actuating said pipe holding means upwardly and downwardly relative to said column structure.

45. A well pipe handling machine as recited in claim 42, in which said powered unit is a torque wrench, there being a spinner carried by said column structure for movement therewith between said first and second positions thereof and positioned above said torque wrench.

46. A well pipe handling machine as recited in claim 42, in which said powered unit is a torque wrench, there being a spinner carreid by said column structure for movement therewith between said first and second positions thereof and positioned above said torque wrench, and means for actuating said torque wrench and said spinner upwardly and downwardly relative to said column structure.

47. A well pipe handling machine as recited in claim 42, in whihc said powered unit is torque wrench, there being a spinner carried by said column structure for movement therewith between said first and second positions thereof and positioned above aid torque wrench, and means for actuating said pipe holding means and said torque wrench and said spinner upwardly and downwardly relative to said column structure.

48. A well pipe handling machine as recited in claim 47, including means for actuating said torque wrench upwardly and downwardly relative to said pipe holdinng means.

49. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding holding means are operable to move a pipe supported thereby in vertical condition into or out of aid rack;

a pipe rotating unit operable to engage a vertical section of pipe in alignment with aid string and rotate said pipe section relative to the string about said axis, to connect the pipe section to or disconnect it from the string; and a connection attaching said pipe rotating unit to said column structure for movement with said column structure and pipe holding means and a vertical pipe section carried thereby between said first and second positions of the column structure and adapted to locate said pipe rotating unit in alignment with said axis of the well and string in said first position of the column structure and at a side of said axis in said second position of the column structure.

50. A well pipe handling machine as recited in claim 49, in which said pipe rotating unit is a torque wrench operable in said first position of the column structure to engage a pipe section and said string and rotate them relative to one another about said axis to connect them together or disconnect them.

51. A well pipe handling machine as recited in claim 49, in which said pipe rotating unit is a spinner operable to engage a section of well pipe and power rotate it rapidly about said axis.

52. A well pipe handling machine as recited in claim 49, including means for actuating said pipe holding means and a carried vertical pipe upwardly and downwardly relative to said column structure.

53. A well pipe handling machine as recited in claim 49, including means for actuating said pipe holding means and a carried vertical pipe and said pipe rotating unit upwardly and downwardly relative to said column structure.

54. A well pipe handling machine as recited in claim 49, including means for actuating said pipe rotating unit upwardly and downwardly relative to said column structure.

55. A well pipe handling machine as recited in claim 49, in which aid pipe rotating unit is a torque wrench operable in said first position of said column structure to engage a pipe section and said string and rotate them relative to one another. there being a spinner carried by said column structure above the torque wrench for movement with the column structure and pipe holding means and torque wrench between said first and second positions of the column structure and operable to rotate a pipe section relative to said string.

56. A well pipe handling machine as recited in claim 55, including means for actuating said torque wrench and spinner vertically relative to said column structure.

57. A well pipe handling machine as recited in claim 56, including means for actuating said torque wrench upwardly and downwardly relative to said pipe holding means.

58. A well pipe handling machine as recited in claim 55, including means for actuating said pipe holding means and said torque wrench and spinner vertically relative to said column structure.

59. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in a vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second poisition in which said column structure remains in essentially vertically extending condition but if offset horizontally from said first position and in which said pipe holding means are operable to move a pipe supported thereby in vertical condition into or out of said rack;

a pipe rotating unit operable to engage a vertical section of pipe in alignment with said string and rotate said pipe section relative to the string about said axis, to connect the pipe section to or disconnect it from the string;

a connection attaching said pipe rotating unit to said column structure for movement with said column structure and pipe holding means and a vertical pipe section carried thereby between said first and second position ofthe column structure and adapted to locate said pipe rotating unit in alignment with said axis of the well and string in said first position of the column structure and at a side of said axis in said second position of the column structure; and means for actuating said pipe holding means generally toward and away from said column structure and relative to said pipe rotating unit between a position of vertical alignment with said pipe rotating unit and a position offset horizontally with respect thereto.

60. A well pipe handling machine as recited in claim 59, including means for actuating said pipe holding means and said pipe rotating unit upwardly and downwardly relative to said column structure.

61. A well pipe handling machine for use in a rig having a string of pipe extending vertically along an axis of a well and having rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holdoing means are operable to move a pipe supported thereby in vertical condition into or out of said rack;

a torque wrench operable to engage a vertical section of pipe in alignment with said string and rotate said pipe section and string relative to one another to connected the pipe section to or disconnect it from the string;

a spinner above the torque wrench for rotating the pipe section relative to the string;

connection means attaching said torque wrench and spinner to said column structure for movement with the column structure and pipe holding means between said first and second positions of the column structure and locating said torque wrench and spinner in alignment with said axis of the well and string in said first psotion of the column structure and at a side of said axis in said second position of the column structure; and means for moving said pipe holding means toward and away from said column structure and relative to said torque wrench and spinner between a position of vertical alignment with the torque wrench and spinner and a position offset horizontally with respect thereto.

62. A well pipe handling machine as recited in claim 61, including means for power actuating said pipe holding means and said torque wrench and said spinner upwardly and downwardly relative to said column structure.

63. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means are positioned to move a pipe supported thereby in vertical condition into or out of said rack;

means for shifting said pipe holding means and a vertical pipe supported thereby vertically parallel to said axis relative to said column structure; and means carried by said support column structure for movement therewith between said first and second positions thereof, and operable to engage a vertical pipe section aligned with said string and power rotate said vertical section about the axis of said string.

64. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means are positioned to move a pipe supported thereby in vertical condition into or out of said rack; and means carried by said support column structure for movement therewith between said first and second positions thereof, and operable to engage a vertical pipe section aligned with said string and power rotate said vertical section about the axis of said string.

* * * * *